US007176415B2

(12) United States Patent
Kamitani et al.

(10) Patent No.: US 7,176,415 B2
(45) Date of Patent: Feb. 13, 2007

(54) HEATING METHOD FOR A BAND-SHAPED BODY AND HEATING APPARATUS FOR A BAND-SHAPED BODY

(75) Inventors: Kiyoshi Kamitani, Shizuoka-ken (JP); Kenji Hayashi, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 139 days.

(21) Appl. No.: 11/002,223

(22) Filed: Dec. 3, 2004

(65) Prior Publication Data

US 2005/0121436 A1 Jun. 9, 2005

(30) Foreign Application Priority Data

Dec. 3, 2003 (JP) ..... 2003-404242

(51) Int. Cl.

| | |
|---|---|
| ***F26B 3/04*** | (2006.01) |
| ***F26B 13/10*** | (2006.01) |
| ***F26B 21/10*** | (2006.01) |
| ***F27B 9/28*** | (2006.01) |
| ***F27B 9/36*** | (2006.01) |
| ***F27B 7/04*** | (2006.01) |

(52) U.S. Cl. ..... 219/400; 219/388; 34/492; 34/496; 34/548; 34/566; 34/629; 34/633

(58) Field of Classification Search ..... None
See application file for complete search history.

(56) References Cited

U.S. PATENT DOCUMENTS

| | | | | |
|---|---|---|---|---|
| 4,479,776 | A * | 10/1984 | Smith | 219/388 |
| 5,219,109 | A * | 6/1993 | Shirono | 226/1 |
| 5,347,103 | A * | 9/1994 | LeMieux | 219/400 |
| 5,404,656 | A * | 4/1995 | Matsuda et al. | 34/446 |
| 5,632,201 | A * | 5/1997 | Roch | 101/211 |
| 5,951,734 | A * | 9/1999 | Friedel et al. | 219/400 |
| 6,651,357 | B2 * | 11/2003 | Bria et al. | 34/427 |
| 6,964,117 | B2 * | 11/2005 | Parent | 34/528 |

FOREIGN PATENT DOCUMENTS

| | | | |
|---|---|---|---|
| JP | 02-131174 | | 5/1990 |
| JP | 2530219 | B2 | 9/1990 |
| JP | 04254529 | A * | 9/1992 |
| JP | 6-49175 | A | 2/1994 |
| JP | 2002-14461 | A | 1/2002 |
| JP | 2003-98685 | A | 4/2003 |

* cited by examiner

*Primary Examiner*—Joseph Pelham
(74) *Attorney, Agent, or Firm*—Sughrue Mion, PLLC

(57) ABSTRACT

A heating method and apparatus for a band-shaped body transported in a constant conveying direction in a heating zone so as to heat the band-shaped body is provided. The method includes detecting whether a portion of the band-shaped body at which width and/or thickness changes is passing through the heating zone setting a first supplied heat quantity, and supplying heat with the first supplied quantity to the band-shaped body in the heating zone; and setting a second supplied heat quantity, and supplying heat with the second supplied quantity to the band-shaped body in the heating zone. The method also includes increasing or decreasing at least one of air flow rate or temperature of the heated air stream. The apparatus includes an air flow ratio changing unit which maintains a constant sum of introduced air stream flow rate and bypass air stream flow rate.

20 Claims, 18 Drawing Sheets

HEATING METHOD FOR A BAND-SHAPED BODY AND HEATING APPARATUS FOR A BAND-SHAPED BODY

CROSS-REFERENCE TO RELATED APPLICATION

This application claims priority under 35 USC 119 from Japanese Patent Application No. 2003-404242, the disclosure of which is incorporated by reference herein.

BACKGROUND OF THE INVENTION

1. Field of the Invention

The present invention relates to a heating method and a heating apparatus for a band-shaped body. The invention particularly relates to a heating method and heating apparatus that heat and dry a coating liquid applied to a band-shaped body in such a way as to enable a temperature history of the band-shaped body to be practically uniform on both upstream and downstream sides of a joint portion passing through, at which joint portion two band-shaped bodies with at least one of different widths or different thicknesses are joined.

2. Description of the Related Art

Planographic printing plates, silver salt films such as photographic films and cinefilms, photographic paper, and magnetic recording materials such as audio tapes, video tapes, base films of floppy (registered trademark) discs are manufactured in the following manner. While a band-shaped body such as a support web, a base film, or baryta paper is conveyed in a constant direction, a coating liquid such as a photosensitive layer forming liquid, a heat-sensitive layer forming liquid, a photosensitive emulsion, or a magnetic layer forming liquid is applied to the band-shaped body. This coating is then dried and then the dried band-shaped body is cut into predetermined sizes to suit.

The following examples of drying methods and drying devices for drying the coating liquid applied to the band-shaped body are proposed:

a method for drying a photographic photosensitive band-shaped material in which a band-shaped material to which a coating liquid including an organic solvent is applied is continuously conveyed, the coating liquid is dried to touch-dry at a temperature of 150 to 190% and air stream velocity of 3 to 30 m/s, and then residual solvent in the coating film is evaporated by a heating roll (Japanese Patent Publication (JP-B) No. 6-49175);

a band-shaped material drying device including a heating roll arranged so as to be capable of contacting with the conveyed band-shaped material, a swing roll that determines a contact angle between the heating roll and the band-shaped material, and a swing roll moving unit that moves the swing roll so that the contact angle changes according to a thickness of the band-shaped material (U.S. Pat. No. 2,530,219);

a planographic printing plate manufacturing method including drying and heating consisting of: continuously conveying a band-shaped support member while applying a photosensitive coating liquid including an organic solvent, forming a photosensitive coating layer; drying the photosensitive coating layer to touch-dry using a first heating unit; and heating the support member and the photosensitive coating layer using a second heating unit provided downstream of the first heating unit, so as to accelerate hardening of the photosensitive coating layer (Japanese Patent Application Laid-Open (JP-A) No. 2002-14461); and a planographic printing plate drying device including: an energy applying unit that applies energy for drying a coating liquid of a moving planographic printing plate; a temperature measuring device that is arranged downstream of an area in which the energy is applied by the energy applying unit, and measures the temperature of the planographic printing plate; and an adjusting unit that adjusts the amount of the energy to be applied by the energy applying unit to the planographic printing plate according to the temperature of the planographic printing plate measured by the temperature measuring device (JP-A No. 2003-98685).

In recent years, in addition to so-called conventional printing plates such as conventional type PS plates, Computer to Plate printing plates, where printing images are directly written thereon by a laser beam based on image data from a computer, have become widely used.

In general, when a support web is switched during the manufacturing of planographic printing plates, an end of one support web is joined to another support web with a different width or different thickness. Since the width or the thickness of the support web changes at the joint portion, thermal capacity of the support web also changes at the joint portion. Therefore if the quantities of heat supplied to the support web are the same on each (upstream, downstream) side of the joint portion then a difference in the temperature history of the support web will arise in the vicinity of the joint portion.

With conventional printing plates, the influence, on quality, of differences in the temperature history in the drying step after the photosensitive layer forming liquid is applied to the support web is comparatively small. For this reason, when conventional printing plates are produced under constant drying conditions, variations in quality due to changes in the quantity of heating of the photosensitive layer caused by the change in thermal capacity of the support web fall within acceptable tolerances.

With Computer to Plate (CTP) printing plates, however, since the influence of drying temperature history on quality is greater than with conventional printing plates, it is necessary to set the drying conditions according to the thickness of the support web. When a support web having non-uniform thickness is continuously driven, it is necessary to change the drying conditions at the joint portion.

When, however, the drying condition is changed, a certain time is required until the drying conditions become stable. For this reason, during the interval from the time when the drying conditions are changed to the time when the drying conditions become stable, the quality cannot be guaranteed, resulting in considerable waste.

It follows that when CTP printing plates having a support web with a certain thickness are manufactured, followed by production of CTP printing plates having a different thickness of support web, dummy plates have to be inserted or the line has to be stopped so that the drying conditions can be changed. Manufacturing of the CTP plates having the different support web thickness can then start.

For this reason, manufacturing productivity for CTP plates is significantly lower than that of conventional printing plates.

SUMMARY OF THE INVENTION

The present invention relates to a heating method and heating apparatus for a band-shaped body that makes it possible to minimize the production time, material and product loss, and product quality fluctuation due to a change in drying conditions, which method is applicable to the manufacture of band-shaped bodies whose quality is greatly influenced by temperature history such as CTP plates.

From a first aspect of the invention, a heating method for a band-shaped body of transported in a constant direction in a heating (drying) zone so as to heat it, includes: detecting whether or not a joint portion of the band-shaped body is passing through the heating zone, at which joint portion a first band-shaped body is joined to a second band-shaped body with at least one of different width or different thickness; before detecting the joint portion pass into the heating zone, setting a first supplied heat quantity based on dimensions of the first band-shaped body on a downstream side of the joint portion in the conveying direction, and supplying heat with the first supplied quantity to the band-shaped body in the heating zone; and after detecting that the joint portion has passed into the heating zone, setting a second supplied heat quantity based on dimensions of the second band-shaped body on an upstream side of the joint portion relative to the conveying direction, and supplying heat with the second supplied quantity to the band-shaped body in the heating zone, so as to adjust a temperature history of the band-shaped body so that the temperature history is approximately uniform on both upstream and downstream sides of the joint portion.

According to this aspect of the heating method for a band-shaped body, in the case where a joint portion is present where an end of a first support web is joined to a second support web with width and/or thickness different from those of the first support web, i.e., when the joint portion passes through the heating zone, the supplied heat quantity into the heating zone is changed from a first supplied heat quantity, related to the width or the thickness of the band-shaped body on the downstream side of the joint portion, into a second supplied heat quantity related to the width or the thickness on the upstream side of the joint portion. As a result, the temperature history of the band-shaped body is maintained approximately constant on both (upstream and downstream) sides of the joint portion.

When, therefore, the heating method for a band-shaped body is applied to the manufacturing of planographic printing plates whose quality is greatly influenced by the temperature history, such as thermal CTP printing plates, the quality can be maintained constant on both (upstream and downstream) sides of the joint portion.

In the planographic printing plate manufacturing method disclosed in JP-A No. 2002-14461, only after a first heating unit, such as a hot air blower drying device, dries a photosensitive coating layer to touch-dry, is the supplied heat quantity controlled according to the width and thickness of the support web at a drying and heating step using a second heating unit.

In the planographic printing plate drying apparatus in JP-A No. 2003-98685, a temperature measuring device measures the temperature of the planographic printing plate during drying, and an amount of energy applied to the planographic printing plate is adjusted according to the measured temperature.

Compared with the above in the heating method for band-shaped body of the invention, the supplied heat quantity is controlled right from the outset, based on the width and thickness of the support web. For this reason, even if the dimensions of the band-shaped body such as a support web change and thus differences in the temperature history of the band-shaped body occur, such differences in the temperature history due to changes in the dimension of the support web can be effectively overcome.

The supplied heat quantity is adjusted from the first supplied heat quantity, predetermined based on the width and thickness on the downstream side of the joint portion, into the second supplied heat quantity, predetermined based on the width and/or the thickness of the band-shaped body on the upstream side of the joint portion. The supplied heat quantity is adjusted in such a manner by feedforward control.

Unlike the feedback control disclosed in JP-A No. 2003-98685, therefore, control delay or hunting does not occur, and quick temperature control can be carried out. For this reason, according to the heating method for band-shaped body of the invention, time, material and product losses can be eliminated effectively. Also planographic printing plates whose plate-making layer is heated and dried by the heating method, particularly thermal CTP plates, have excellent quality stability on both (upstream and downstream) sides of the joint portion.

In the present specification, by "the temperature history of the band-shaped body" is meant a temperature change of the band-shaped body inside the heating zone. Further, in other words, it is a change in the surface temperature of the band-shaped body in the heating zone.

Examples of the "band-shaped body having a joint portion where at least one of its width or its thickness changes" include a band-shaped body where an end of one band-shaped body is joined to another band-shaped body with different width and/or thickness like the above support web. They are, however, not limited to a band-shaped body where one band-shaped body is joined to another band-shaped body as long as there is a portion where at least one of the width or the thickness changes in the conveying direction of the band-shaped body.

It is preferable that the supplied heat quantity change is completed during the period that the above section of the band-shaped body moves between the inlet and the outlet of the heating zone in order that the losses due to the change in the conditions is kept to a minimum.

It is also suitable to provide a detecting unit, for detecting changes in the width or the thickness of the band-shaped body, adjacent to the heating zone on the upstream side, so that the supplied heat quantity in the heating zone may be changed as soon as the detecting unit detects changes in the width or the thickness of the band-shaped body.

In the case where an end of one band-shaped body is joined to another band-shaped body with a different width and/or thickness, the location of the section where the width and/or thickness changes can be determined by time and conveying speed. For this reason, when the conveying speed of the band-shaped body is constant, a timer may be set so that the supplied heat quantity is changed when the section is assumed to be passing through the heating zone.

Examples of the heating method for a band-shaped body in the heating zone with a heated air stream include heating with: a surface air stream supply, such that a heated air stream is applied to the front surface of the band-shaped body; a rear surface air steam supply, such that a heated air stream is applied to a rear surface of the band-shaped body; and a dual surface air stream supply, such that a heated air stream is applied to both front and rear surfaces of the band-shaped body. Examples of heating methods further include: an induction heating method by applying an alternating magnetic field to the band-shaped body and generating induced current so as to heat the band-shaped body; and a radiant heating method, by irradiation with infrared rays or the like, so as to heat the band-shaped body. The heating method, however, is not limited as long as the band-shaped body can be heated in a non-contact method. Further the induction heating or the radiant heating methods can be combined with heating with the heated air stream.

Examples of the method for changing the supplied heat quantity to the band-shaped body in the heating zone include a method of changing the air flow rate and/or temperature of the heated air stream. In the case of induction heating, the strength of the alternating field applied may be changed. In the case of radiant heating, the strength of infrared rays irradiated may be changed.

The band-shaped body is not particularly limited as long as it is of a band shape and is a thin plate or film type of product that is flexible. The surface of the band-shaped body may be subject to various processes such as a graining process and an anodizing process on the support web. The band-shaped body may be one where a coating liquid is not applied, or one where a coating liquid has been applied to a surface. Or it may be one where the coating liquid is applied, then dried so that a coating film is formed on a surface.

Specific example of the band-shaped body include the support webs for planographic printing plates, film bases of a photographic recording material for photographic films and cinefilms, baryta paper for photographic papers, base materials for magnetic recording materials (made of polyester or the like) such as recording tapes, video tapes and floppy (registered trademark) discs, and metallic thin plates for coated metal plates such as color iron plate.

Further, the band-shaped body may be a tape-shaped body composed of various papers such as kraft paper, parchment paper, polyethylene-coated paper.

Examples of the coating liquid which can be applied to the band-shaped body include: a plate-making layer forming liquid which is applied to support webs and is dried so as to form plate-making layers of conventional printing plates; a protective layer forming liquid which is applied to the plate-making layers of CTP printing plates and is dried so as to form protective layers; a primer forming liquid for forming a primer for improving the adhesion between the support web and the plate-making layer on the grained surface of the support web; and various solvents.

Examples of the coating liquid further include: photosensitive emulsions used for forming photosensitive layers such as for photographic films, cinefilms and photographic papers; an antihalation layer forming liquid to be used for forming antihalation layers of photographic films and the cinefilms; a magnetic recording layer forming liquid for forming magnetic recording layers in magnetic recording materials; various coating materials to be used for primer coating, intermediate coating and top coating of coated metal plates. The coating liquid, however, is not limited to these examples as long as it is a solution, suspension, solvent, or the like capable of coating the base material.

The viscosity of the coating liquid is preferably not more than approximately 100 mPa·s, and not more than approximately 50 mPa·s is particularly preferable. It is preferable that the surface tension falls within a range of approximately 20 to 70 mN/m.

The conveying speed of the band-shaped body can be suitably set according to production speed, the coated thickness of the coating liquid, a desired surface quality of the coated surface. Not less than approximately 10 m/minute is preferable, and a range of approximately 40 to 200 m/minutes is particularly preferable.

A second aspect of the invention is to provide a heating method for a band-shaped body that further includes: dividing the heating zone into two or more blocks in the conveying direction of the band-shaped body; and when the joint portion of the band-shaped body passes through the heating zone, changing a supplied heat quantity to the blocks successively starting from the block on the upstream side relative to the conveying direction of the band-shaped body.

The above heating method for a band-shaped body is preferable in that the loss of time, materials and products during changing of the supplied heat quantity can be minimized.

A third aspect of the invention is to provide a heating method for a band-shaped body that further includes: applying a heated air stream towards the path of the passing band-shaped body so as to heat a coating liquid in the heating zone; and increasing or decreasing at least one of air flow rate and/or temperature of the heated air stream so as to change the quantity of heat supplied to the band-shaped body.

In the above heating method for a band-shaped body, at least one of the air flow rate and/or the temperature of the heated air stream is changed, so that the supplied heat quantity in the heating zone is changed. For this reason, in comparison with a case where a nozzle for blowing out the heated air stream is moved closer to or further away from the conveyed surface of the band-shaped body, the supplied heat quantity can be changed more quickly.

In a drying line of planographic printing plates, the plate-making layer forming liquid or the protective layer forming liquid applied to the support web is generally dried by the heated air stream. For this reason, the heating method according to the third aspect of the invention can be introduced without modifying a conventional drying line.

The air flow rate of the heated air stream can be changed easily and quickly by, for example, providing a damper to the air stream supply flow channel for introducing the heated air stream into the heating zone and adjusting the opening amount of the damper. The heated air stream can be generated by generating an air stream using an air stream supply fan or an air stream supply blower and heating the air stream using a suitable heating unit. In order that the temperature and the air flow rate in the heating zone be stabilized within a short time, it is desirable that the air flow rate of the air stream allowed to pass across the above heating unit is constant.

A fourth aspect of the invention is to provide a heating method for a band-shaped body which further includes: detecting the passing of the joint portion of the band-shaped body, on the upstream side of the heating zone relative to the conveying direction; and changing the supplied heat quantity to the heating zone based on the detected result.

In the heating method for a band-shaped body according to the fourth aspect of the invention, the detection of the passing of the joint portion of the band-shaped body is carried out on the upstream side of the heating zone, and the supplied heat quantity in the heating zone is changed based on the detected result. This method is preferable because it can be ensured that the change in the supplied heat quantity is completed while the joint portion is between the inlet and the outlet of the heating zone.

A fifth aspect of the invention provides a heating method for a band-shaped body further includes: in the heating zone, conveying in a constant direction the band-shaped body having a coating liquid provided to at least one surface thereof and simultaneously heating the band-shaped body so that the coating liquid is dried.

A sixth aspect of the invention provides a heating method for a band-shaped body where the band-shaped body is a planographic printing plate.

The heating method of a band-shaped body according to the fifth aspect is an example of the heating method from the first aspect being applied to drying of a coating liquid applied to the surface of a band-shaped body. The heating method of a band-shaped body from the sixth aspect is an example of the heating method of the fifth aspect being applied to the manufacturing of planographic printing plates.

A seventh aspect of the invention provides a heating apparatus for a band-shaped body that includes: a heating zone, where a heated air stream is applied to at least one surface of a band-shaped body being conveyed in a constant direction so as to heat the band-shaped body; a heated air stream generating unit, that generates a heated air stream; and a heated air stream supply flow channel for introducing the heated air stream generated by the heated air stream generating unit into the heating zone, wherein: the heated air stream generating unit has: an air stream generating unit that generates an air stream; and a heating unit that heats the air stream generated by the air stream generating unit; in the heated air stream generating unit, the air stream generating unit generates air stream with a constant air flow rate and the air stream thus generated is made to pass through the heating unit, so as to generate the heated air stream with a constant air flow rate and constant temperature; and the heated air stream supply flow channel has a heated air flow rate adjusting unit that adjusts, when introducing the heated air stream generated by the heated air stream generating unit into the heating zone, the air flow rate of the air stream to be introduced.

In the heating apparatus for a band-shaped body from the seventh aspect, the heated air stream generating unit generates the heated air stream with constant air flow rate and temperature. The heated air flow rate adjusting unit provided in the heated air stream supply flow channel adjusts the air flow rate of the heated air stream to be introduced into the heating zone, so that the quantity of heat fed into the heating zone is changed.

Therefore, unlike in a case where the heated air stream generating unit controls the air flow rate and the temperature of the heated air stream, the quantity of heat fed into the heating zone can be changed quickly, and heating conditions in the heating zone become stable within a short time after the supplied heat quantity is changed. For this reason, the loss of time and products while changing the supplied heat quantity can be minimized.

Examples of the heating unit include various heaters such as electric, gas, gas burner and combustion heaters.

Examples of the heated air flow rate adjusting unit include a damper provided in the heated air stream introduction flow channel and the like.

An eighth aspect of the invention is a heating apparatus for a heating apparatus for a band-shaped body of the seventh aspect that is constituted so that: detection can be made of a joint portion, where one band-shaped body is joined to another band-shaped body of a different width and/or thickness, passing through the heating zone. Before the passing of a joint portion is detected: a first supplied heat quantity is set, based on dimensions of the band-shaped body on the downstream side of the detector in the conveying direction; and the air flow rate of the heated air stream supplied into the heating zone is adjusted, by the heated air stream air flow rate adjusting unit, so that heat of the first supplied quantity is supplied to the band-shaped body in the heating zone. After the passing of a joint portion is detected: a second supplied heat quantity is set, based on dimensions of the band-shaped body on the upstream side of the joint portion relative to the conveying direction; the air flow rate of the heated air stream supplied to the heating zone is adjusted by the heated air flow rate adjusting unit, so that heat of the second supplied quantity is fed to the band-shaped body in the heating zone. Thus a temperature history of the band-shaped body is capable of being adjusted so as to be approximately uniform on both (upstream and downstream) sides of the joint portion in the conveying direction.

In the above heating apparatus for a band-shaped body when a joint portion of the band-shaped body passes through the heating zone, the heated air flow rate adjusting unit increases or decreases the air flow rate of the heated air stream supplied to the heating zone. As a result, the supplied heat quantity in the heating zone is changed from the first supplied heat quantity to the second supplied heat quantity.

The supplied heat quantity, therefore, can be changed quickly, and after the supplied heat quantity is changed, the heating conditions in the heating zone become stable within a short time. For this reason, the loss of time and products caused by the change in the supplied heat quantity is virtually zero.

A ninth aspect of the invention provides a heating apparatus for a band-shaped body of the seventh or eighth aspects which further includes: a bypass flow channel that is branched from the heated air stream supply flow channel, and is used for bypassing at least part of the heated air stream generated by the heated air stream generating unit away from the heating zone; and an air flow ratio changing unit. While the air flow ratio changing unit maintains a constant sum of introduced air stream flow rate and bypass air stream flow rate, the introduced air stream flow rate being the flow rate of the heated air stream supplied to the heating zone through the heated air stream introduction flow channel, and the bypass air stream flow rate being the air flow rate of the heated air stream bypassed in the bypass flow channel, the air flow ratio changing unit changes the ratio of the introduced air stream flow rate to the bypass air stream flow rate.

The heating apparatus for a band-shaped body from the ninth aspect is an example where the bypass flow channel is provided to the heating apparatus for a band-shaped body from the seventh or the eighth aspect, the bypass flow channel being used for bypassing the excess heated air stream remaining from the heated air stream generated by the heated air stream generating unit after the heated air stream is introduced into the heating zone.

A tenth aspect of the invention provides a heating apparatus for a band-shaped body from the ninth aspect that further includes a return flow channel for: combining, on downstream of the heating zone, the heated air stream which was introduced into the heating zone and the heated air stream which was introduced into the bypass flow channel; and returning at least part of the combined air stream to the heating unit.

In the heating apparatus for a band-shaped body from the tenth aspect, the heated air stream introduced from the heated air stream supply flow channel into the heating zone, as well as the heated air stream introduced into the bypass flow channel, both pass through the return flow channel so as to be returned into a circulation flow channel.

When the air flow rate of the heated air stream introduced into the heating zone is changed, the balance between the air flow rate of the heated air stream flowing from the heating zone and the air flow rate of the heated air stream flowing through the bypass flow channel changes. At this time, the temperature of the inlet of the heating unit changes. However, this change can be minimized according to the present aspect and so the heating unit can be operated under constant conditions.

In the heating apparatus for a band-shaped body as described in the above aspect, a fresh air stream supply flow channel for introducing a fresh air stream may be provided to the inlet of the heating unit. In the heating apparatus for a band-shaped body of the invention, when the width and/or the thickness of the band-shaped body passing through the heating zone changes, the heating load for heating the band-shaped body also changes. However, by introducing the fresh air stream upstream of the heating unit via the fresh air stream supply flow channel, the fluctuations in the heating load for heating the band-shaped body can be suppressed to a small amount.

An eleventh aspect of the invention provides a heating apparatus for a band-shaped body that includes: a heating zone for applying a heated air stream to at least one surface of a band-shaped body conveyed in a constant direction, so as to heat the band-shaped body; plural heated air stream generating units that generate heated air streams with different temperatures; a heated air stream supply flow channel for introducing the heated air stream generated by the heated air stream generating units into the heating zone; and a heated air stream introduction ratio adjusting unit, that is provided on the heated air stream supply flow channel, and adjusts a ratio of introduced air flow rates of the heated air streams to be introduced from each of the heated air stream generating units into the heating zone. The heated air stream generating units allow an air stream with constant air flow rate to pass through a heating unit so as to generate the heated air streams.

In the heating apparatus for a band-shape body from the eleventh aspect, the temperatures and air flow rate of the air streams in each of the heated air stream generating units and the heating units are kept constant. When the ratio of the heated air streams fed from each of the heated air stream generating units is changed, the temperature of the heated air stream fed to the heating zone is increased or decreased so that the supplied heat quantity into the heating zone is changed.

After the temperature of the heated air stream fed to the heating zone is changed so that the supplied heat quantity is adjusted, it does not take a long time before the heating conditions of the heating zone become stable. For this reason, the loss of time and products due to the change in the supplied heat quantity can be minimized.

A twelfth aspect of the invention provides a heating apparatus for a band-shaped body that includes: a heating zone, for applying a heated air stream to at least one surface of a band-shaped body being conveyed in a constant direction so as to heat the band-shaped body; plural heated air stream generating units, that generate heated air streams with different temperatures; a heated air stream supply flow channel, for introducing the heated air streams generated by the heated air stream generating units into the heating zone; and a heated air stream supply flow channel switching unit that is provided on the heated air stream supply flow channel and switches the heated air stream supply flow channel so that heated air streams are introduced from at least one of the heated air stream generating units into the heating zone. The heated air stream generating units allow an air stream with constant air flow rate to pass through a heating unit so as to generate the heated air streams.

In the heating apparatus for a band-shaped body according to the twelfth aspect, when the band-shaped body obtained by jointing band-shaped bodies with different thicknesses is heated, the air flow rate and the temperature of the heated air stream are set, according to the thickness of the band-shaped body, in the heated air stream generating units. Every time when a portion of the band-shaped body where the thickness changes passes through the heating zone, the heated air stream supply flow channel switching unit switches the heated air stream generating units that supply the heated air streams to the heating zone. As a result, the band-shaped body can be heated with the supplied heat quantity appropriate to the thickness of the body. The temperature history, therefore, can be made uniform for all portions of the band-shaped body.

Unlike a feedback control which is widely used conventionally, the heated air stream generating units can be controlled by a feedforward control. For this reason, a control delay or hunting which occurs in feedback control does not occur.

A thirteenth aspect of the invention provides a heating apparatus for a band-shaped body according to the seventh to twelfth aspects that further includes: a joint portion detecting unit that is positioned upstream of the heating zone, and detects a joint portion, namely a portion where one band-shaped body is joined to another band-shaped body of different width and/or thickness, passing through the heating zone; a production management information storage unit that stores production management information relating to the widths and thicknesses of the band-shaped bodies passing through the heating zone; and a control unit. The control unit: reads the dimensions of the portion of the band-shaped body upstream of the joint portion, from the production management information storage unit, when the joint portion detecting unit detects a joint portion; sets an introduced air flow rate or an introduction ratio of heated air streams based on the read dimensions, so that a temperature history of the band-shaped body becomes substantially uniform on both (upstream and downstream) sides of the joint portion; and controls the heated air flow rate adjusting unit or the heated air stream introduction ratio adjusting unit.

In the heating apparatus for a band-shaped body according to the thirteenth aspect, when the joint portion detecting unit detects a joint portion of the band-shaped body, the control unit reads the dimensions of the band-shaped body on the upstream side of the joint portion from the production management information storage unit. The heated air flow rate adjusting unit or the heated air stream introduction ratio adjusting unit is controlled, based on the dimension of the band-shaped body read from the production management information storage unit, so that the temperature history of the band-shaped body becomes substantially uniform on both sides of the joint portion.

The series of operations, from the detection of the joint portion to the control of the heated air flow rate adjusting unit or the heated air stream introduction ratio adjusting unit, is performed automatically.

A fourteenth aspect of the invention provides the heating apparatus for a band-shaped body according to the seventh to thirteenth aspects being constituted so that: the heating zone is divided into two or more blocks in the conveying direction of the band-shaped body, and when the joint portion detecting unit detects the joint portion, the supplied heat quantity is changed successively starting from the upstream block of the heating zone.

The heating apparatus for a band-shaped body according to the fourteenth aspect is preferable since the loss of time, materials and products at the time of changing the supplied heat quantity can be minimized in the same way as in the heating method for a band-shaped body from the second aspect.

A fifteenth aspect of the invention provides the heating apparatus for a band-shaped body according to the seventh to fourteenth aspects being constituted so that the band-shaped body is a support web which is a support material of a planographic printing plate, and the heating apparatus for a band-shaped body heats and dries a coating liquid applied to at least one surface of the support web.

The heating apparatus for a band-shaped body from the fifteenth aspect is an example where the heating apparatus for a band-shaped body of the invention is applied to the case where a plate-making layer forming liquid or a protective layer forming liquid is applied to a planographic printing plate and is dried so that a plate-making layer or a protective layer is formed.

The invention provides a heating method and a heating apparatus for a band-shaped body in which: micro flaws are not generated; the temperature history of the band-shaped body can be made approximately constant, even when the thickness or the width of the band-shaped body abruptly changes; and the loss of time, materials and products and variations of product quality accompanying changes in drying and curing conditions can be minimized.

DETAILED DESCRIPTION OF THE INVENTION

[First Embodiment]

A heating apparatus for a band-shaped body according to a first embodiment is explained below.

Figure 1:
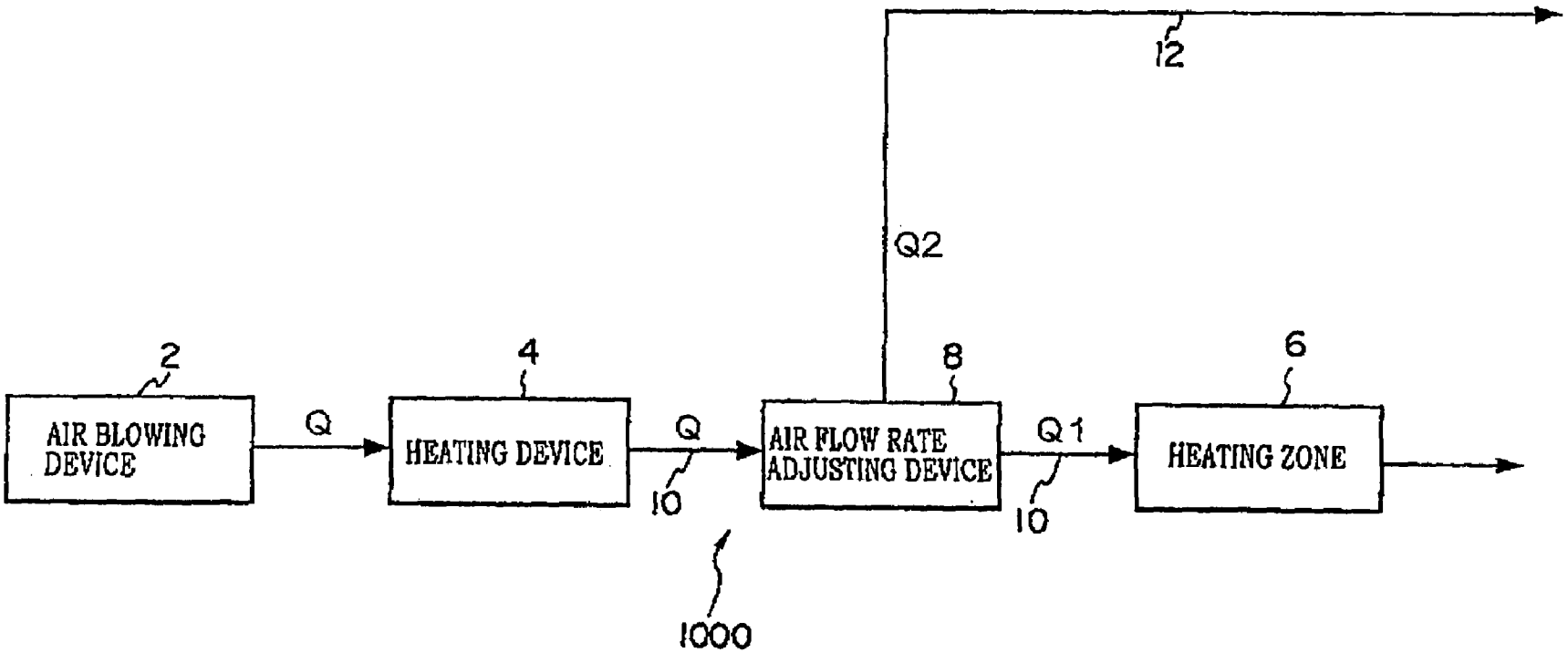
FIG. 1 is a schematic block diagram illustrating a constitution of a heating apparatus for a band-shaped body according to a first embodiment.

As shown in FIG. 1, the heating apparatus for a band-shaped body 1000 according to the first embodiment includes an air blowing device 2, a heating device 4, a heating zone 6, a heated air stream supply flow channel 10, an air flow rate adjusting device 8, and an excess air stream discharge flow channel 12. The air blowing device 2 generates an air stream with a constant air flow rate Q. The heating device 4 heats the air stream generated by the air blowing device 2. The heated air stream generated by the heating device 4 is introduced into the heating zone 6. The heated air stream supply flow channel 10 is used for introducing the heated air stream from the heating device 4 into the heating zone 6. The air flow rate adjusting device 8 is provided on the heated air stream supply flow channel 10, and divides the heated air stream with air flow rate Q, generated by the air blowing device 2 and the heating device 4, into: an introduced air stream of air flow rate Q1, to be introduced into the heating zone 6; and an excess air stream of air flow rate Q2, to be discharged out of the heating apparatus for a band-shaped body 1000 system through the excess air stream discharge flow channel 12 which is branched from the air flow rate adjusting device 8.

The air blowing device 2, the heating device 4, and the air flow rate adjusting device 8 correspond to an air stream generating unit, a heating unit, and a heated air flow rate adjusting unit respectively, as provided in the heating apparatus for a band-shaped body of the present invention.

For the air blowing device 2, a blower, a fan, or the like is used. For the heating device 4, various heaters such as an electric heater, a gas heater, a gas burner, and a combustion heater can be used.

An example of the air flow rate adjusting device 8 includes a variable damper having a variable opening, and provided to the heated air stream supply flow channel 10 and the excess air stream discharge flow channel 12.

Figure 2:
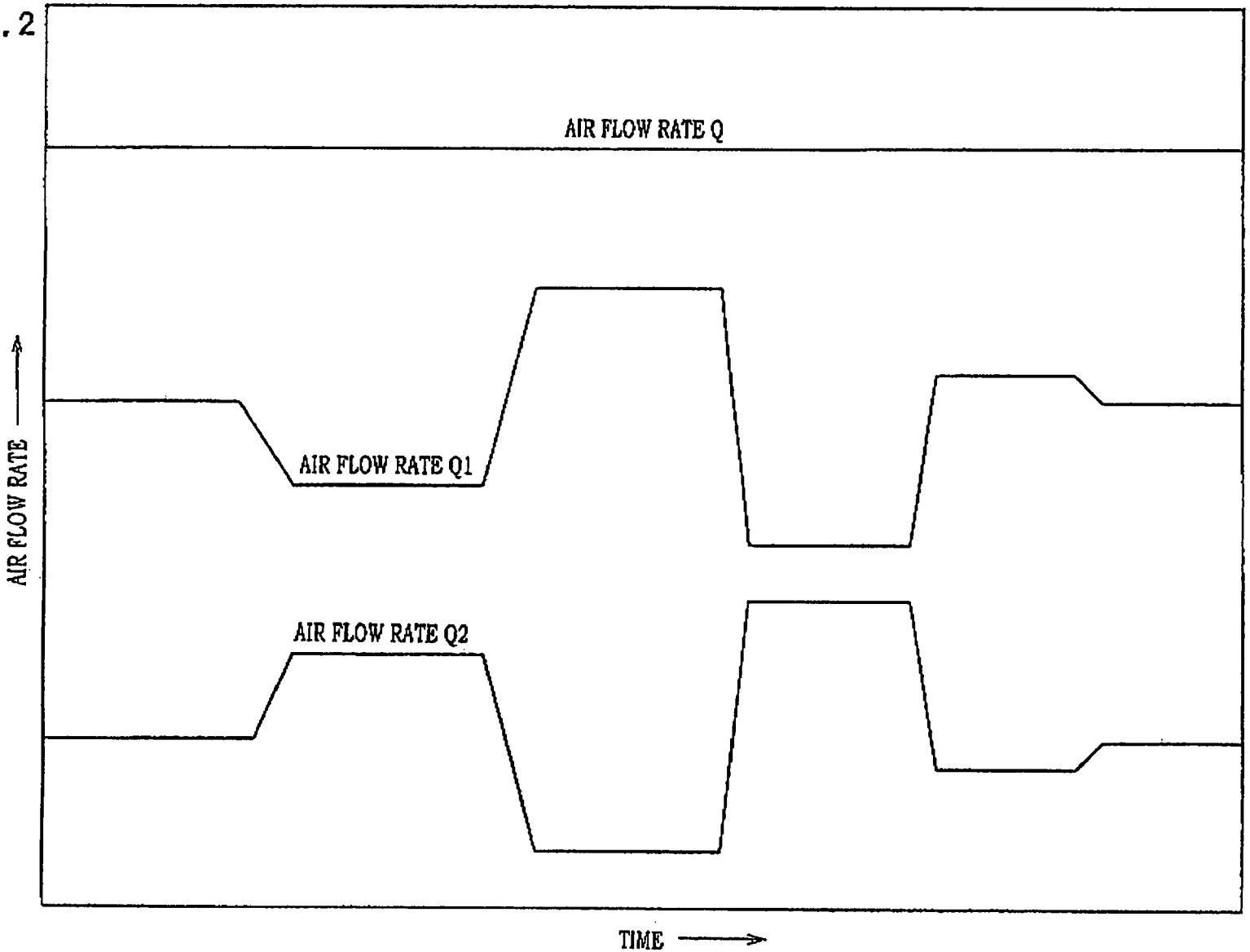
FIG. 2 is a is a graph illustrating a relationship between air flow rate Q1 of introduced air stream introduced into a heating zone and air flow rate Q2 of excess air stream discharged from a system in an air flow rate adjusting device provided to the heating apparatus for a band-shaped body according to the first embodiment.

As shown in FIG. 2, the air flow rate adjusting device 8 is controlled so that the sum of the air flow rate Q1 of the introduced air stream and the air flow rate Q2 of the excess air stream always becomes equal to the air flow rate Q of the heated air stream.

Figure 3:
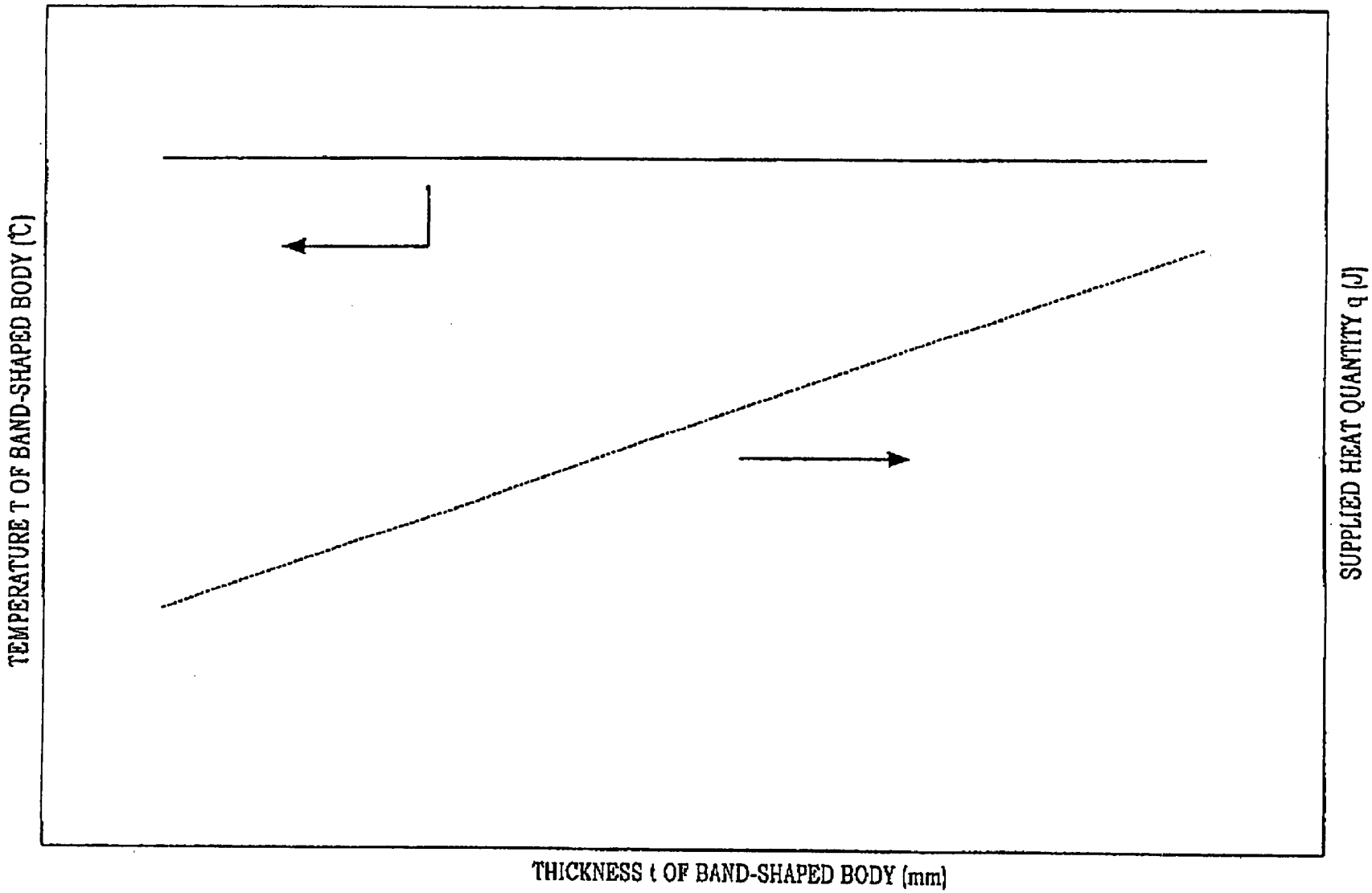
FIG. 3 is a graph illustrating a relationship between a thickness of the band-shaped body to be heated by the heating apparatus for a band-shaped body according to the first embodiment, supplied heat quantity in the heating zone, and a surface temperature of the band-shaped body.

As shown in FIG. 3, when a thickness t (mm) of a band-shaped body is increased, the air flow rate Q1 of the introduced air stream is increased, and when the thickness t (mm) of the band-shaped body is reduced, the air flow rate Q1 of the introduced air stream is also reduced. Specifically, the air flow rate adjusting device 8 being controlled so that a quantity q of heat fed into the heating zone 6 is increased or decreased so that a surface temperature T (° C.) of the band-shaped body, namely a temperature history, is made to be uniform.

Figure 4:
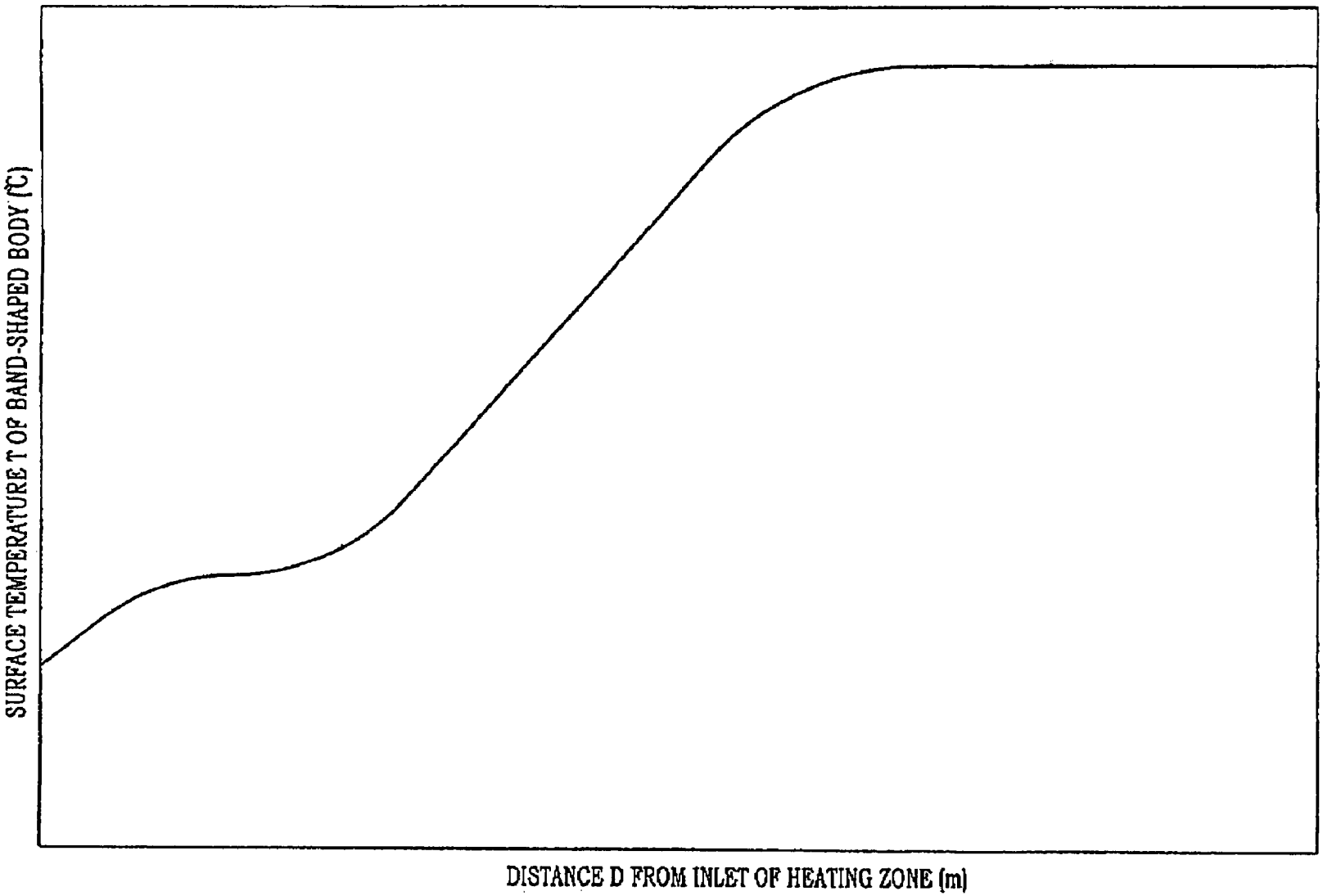
FIG. 4 is a graph illustrating a relationship between a distance from an inlet of the heating zone and the surface temperature of the band-shaped body in the heating apparatus for a band-shaped body according to the first embodiment.

As shown in FIG. 4, since the band-shaped body introduced into the heating zone 6 is heated immediately by the introduced heated air stream, the surface temperature T of the band-shaped body reaches a predetermined value by approximately the middle portion of the heating zone 6, and thereafter it remains constant.

Consider when a portion where a width and/or a thickness change is present in a band-shaped body as in the case where one band-shaped body is joined to an end of another band-shaped body of a different width and/or thickness. In this case, when the portion passes through the heating zone 6, the heating apparatus for a band-shaped body 1000 controls the air flow rate adjusting device 8, and increases or decreases the air flow rate Q1 of the introduced air stream introduced into the heating zone 6 according to the increase or decrease of the thickness and/or the width of the band-shaped body on both (upstream and downstream) sides of the portion. As a result, the supplied heat quantity into the heating zone 6 can be increased or decreased according to the increase or the decrease in the thickness and/or the width of the band-shaped body.

Since the air flow rate Q1 of the introduction air stream is controlled by feedforward control, quick temperature control can be made without a control delay or hunting, unlike feedback control described in JP-A Nos. 2002-14461 and 2003-98685.

In the air blowing device 2 and the heating device 4, a heated air stream with a constant temperature is generated at a constant air flow rate Q. The air flow rate adjusting device 8 divides the heated air stream into an introduced air stream of air flow rate Q1 and an excess air stream of air flow rate Q2, and introduces only the introduced air stream into the heating zone 6. Thus, compared to a case where the heated air stream generating unit controls the air flow rate and/or the temperature of the heated air stream, the quantity q of the heat to be fed into the heating zone 6 can be changed more quickly. Further, after the supplied heat quantity is changed, the heating conditions in the heating zone 6 become stable within a short period of time.

Since the temperature history in the portion of the band-shaped body can be maintained nearly constant, the quality can be maintained constant before and after the joint portion. This is so even for the quality of a band-shaped body that is greatly influenced by the temperature history, like a thermal CTP. Since the supplied heat quantity can be increased or decreased quickly, loss of time, materials, and products due to increases or decreases in the supplied heat quantity becomes negligible.

[Second Embodiment]

The heating apparatus for a band-shaped body according to a second embodiment is explained below.

Figure 5:
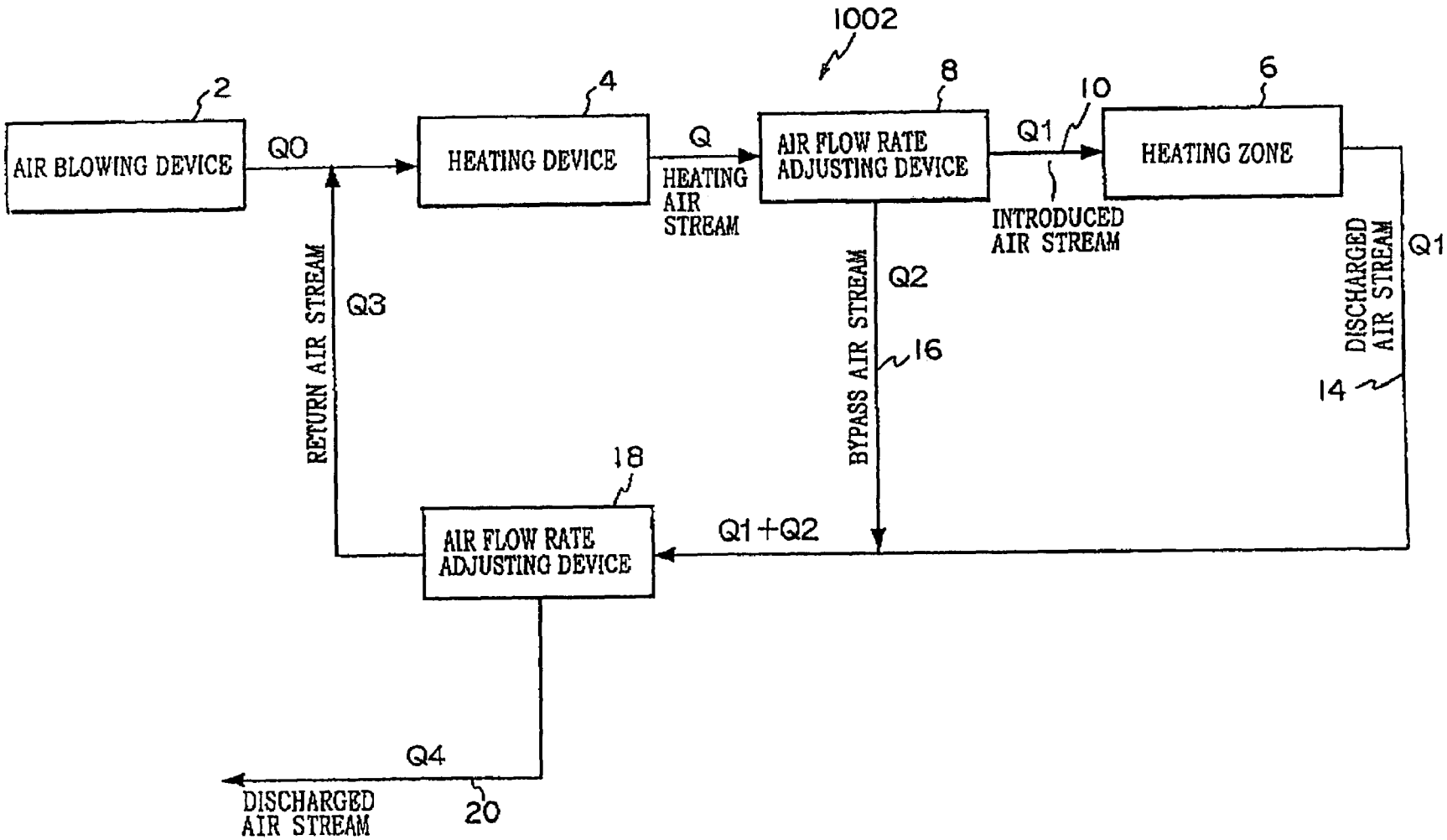
FIG. 5 is a schematic block diagram illustrating a constitution of the heating apparatus for a band-shaped body according to a second embodiment

As shown in FIG. 5, the heating apparatus for a band-shaped body 1002 according to the second embodiment is provided with a return flow channel 14 for returning a discharged air stream from the heating zone 6 to a point between the air blowing device 2 and the heating device 4.

The air flow rate adjusting device 18 is set on the return flow channel 14. This device divides the discharged air stream from the heating zone 6 into a return air stream to the heating device 2 and a discharged air stream discharged out of the band-shaped heating apparatus 1002. The excess air stream discharge flow channel 20 for discharging the discharged air stream out of the system is provided to the air flow rate adjusting device 18.

The air flow rate adjusting device 8 divides the heated air stream introduced from the heating device into: an introduced air stream, to be introduced into the heating zone 6; and a bypass air stream, not to be introduced into the heating zone 6 but to be bypassed to the return flow channel 14. A bypass flow channel 16 for bypassing the bypass air stream to the return flow channel 14 is branched from the air flow rate adjusting device 8. The bypass flow channel 16 is communicatively connected on an upstream side of the air flow rate adjusting device 18 on the return flow channel 14.

An air stream of air flow rate Q0 is generated in the air blowing device 2. The air stream, of air flow rate Q0 generated in the air blowing device 2, and the return air stream, of air flow rate Q3 returned from the return flow channel 14 join together on the upstream side of the heating device 4, so as to be introduced into the heating device 4. In the heating device 4, therefore, a heated air stream of flow rate Q (=Q0+Q3) is generated.

The heated air stream of flow rate Q (=Q0+Q3) generated in the heating device 4 is divided into the introduced air stream of air flow rate Q1 and the bypass air stream of air flow rate Q2 in the air flow rate adjusting device 8.

The introduced air stream passes through the heated air stream supply flow channel 10 so as to be introduced into the heating zone 6. Since the introduced air stream introduced into the heating zone 6 is discharged from the other end of the heating zone 6 with almost the same air flow rate, the discharged air stream of air flow rate Q1 is discharged from the heating zone 6 to the return flow channel 14.

The discharged air stream of air flow rate Q1 and the bypass air stream of air flow rate Q2 are introduced into the air flow rate adjusting device 18 via the return flow channel 14 and the bypass flow channel 16. Since the total of the air flow rate of the discharge air stream and the bypass air stream, Q1+Q2, is constant and equal to Q, when a ratio of the return air stream Q3 to the discharge air stream Q4 in the air flow rate adjusting device 18 is fixed at n:1, the air flow rate Q3 of the bypass air stream is obtained by [n/(n+1)]Q and is also constant.

Figure 6:
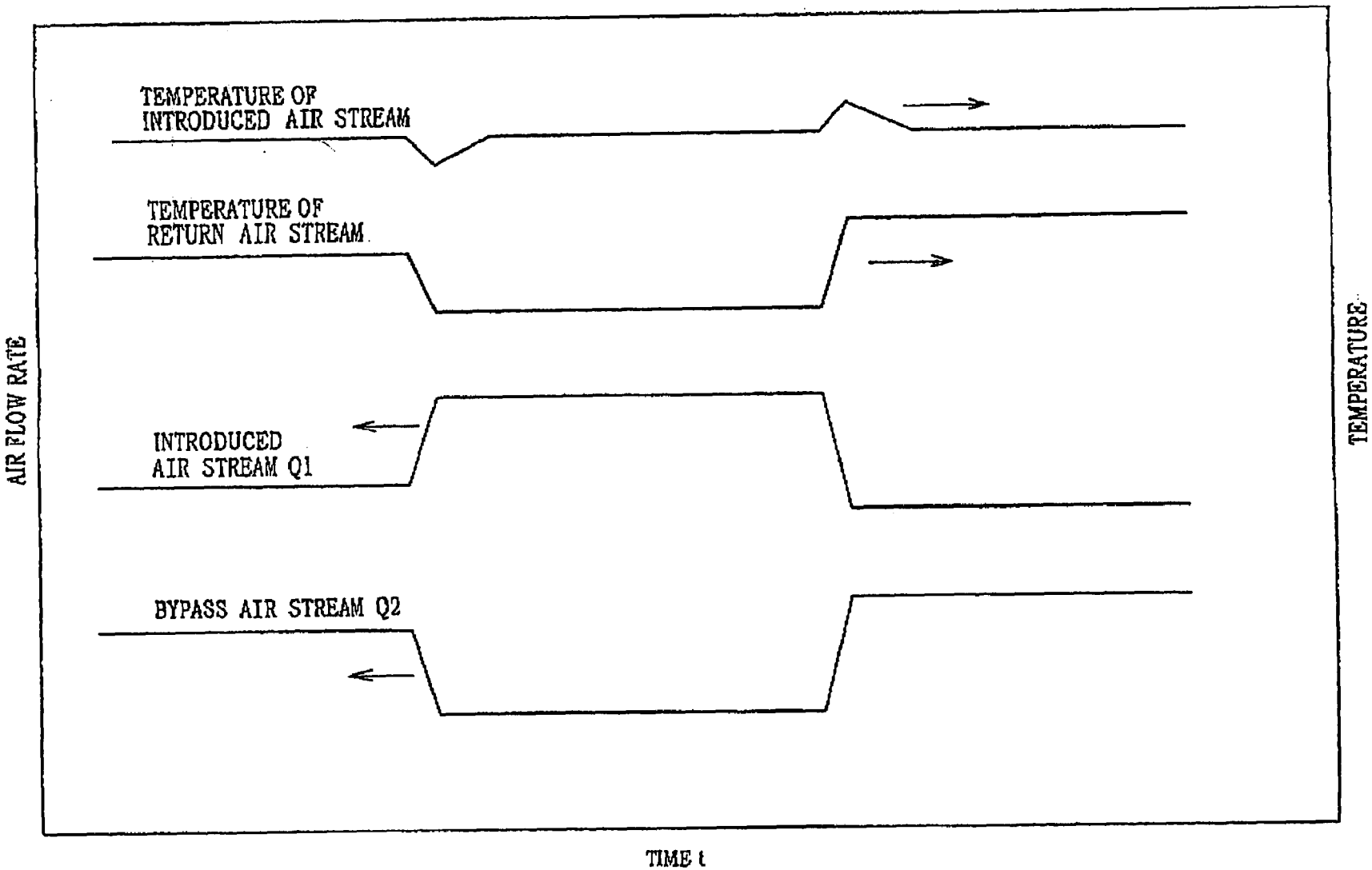
FIG. 6 is a graph illustrating a change in temperature with time of an introduced air stream and a return air stream at the time when the air flow rate of the introduced air stream and a bypass air stream is changed.

When the air flow rate Q1 of the introduction air stream is increased, and the air flow rate Q2 of the bypass air stream is decreased, there is an increase in the ratio of air flowing through the heating zone 6 which experiences a large temperature change. Then, as shown in FIG. 6, the temperature of the return air stream is reduced. As a result, the temperature of the inlet in the heating device 4 is reduced, and thus the temperature of the heated air stream is reduced. The temperature of the introduction air stream, therefore, is reduced momentarily. The heating device 4 has a temperature control device (not shown) that controls the temperature of the heated air stream so that the temperature becomes constant. For this reason, when the temperature of the heated air stream is reduced, the temperature control device is operated so that the temperature of the heated air stream discharged from the heating device 4 is returned to the predetermined temperature.

In a case when the introduced air flow rate Q1 is reduced and the bypass air flow rate Q2 is increased, the ratio is lowered of the introduced air stream that experiences a large temperature change, and there is an increase in the ratio of the bypass air stream. For this reason, the temperature of the return air stream increases. As a result, since the temperature of the inlet in the heating device 4 rises, the temperature of the heated air stream rises momentarily. The temperature of the heated air stream discharged from the heating device 4 is lowered to the set value by the control function of the temperature control device.

In the heating apparatus for a band-shaped body 1002, at least a part of the discharged air stream and the bypass air stream are circulated in the heating device 4. Naturally the bypass air stream has approximately the same temperature as that of the heated air stream. Also the introduced air stream seems not to be cooled greatly in the heating zone 6 and so it can be considered that the temperature of the discharge air stream discharged from the heating zone 6 is the approximately the same as that of the heated air stream. In the heating device 4, therefore, energy efficiency is improved.

A part of the discharge air stream, returned in the return flow channel 14, is discharged out of the system by the air flow rate adjusting device 18. For this reason, even when discharging a discharge air stream containing solvent vapor at high concentration, as in a case where a plate-making layer forming liquid or a protective layer forming liquid applied to the support web are heated and dried in the heating zone so that the plating making layer or the protective layer is formed, an increase in the density of the solvent vapor in the system can be prevented.

[Third Embodiment]

Figure 7:
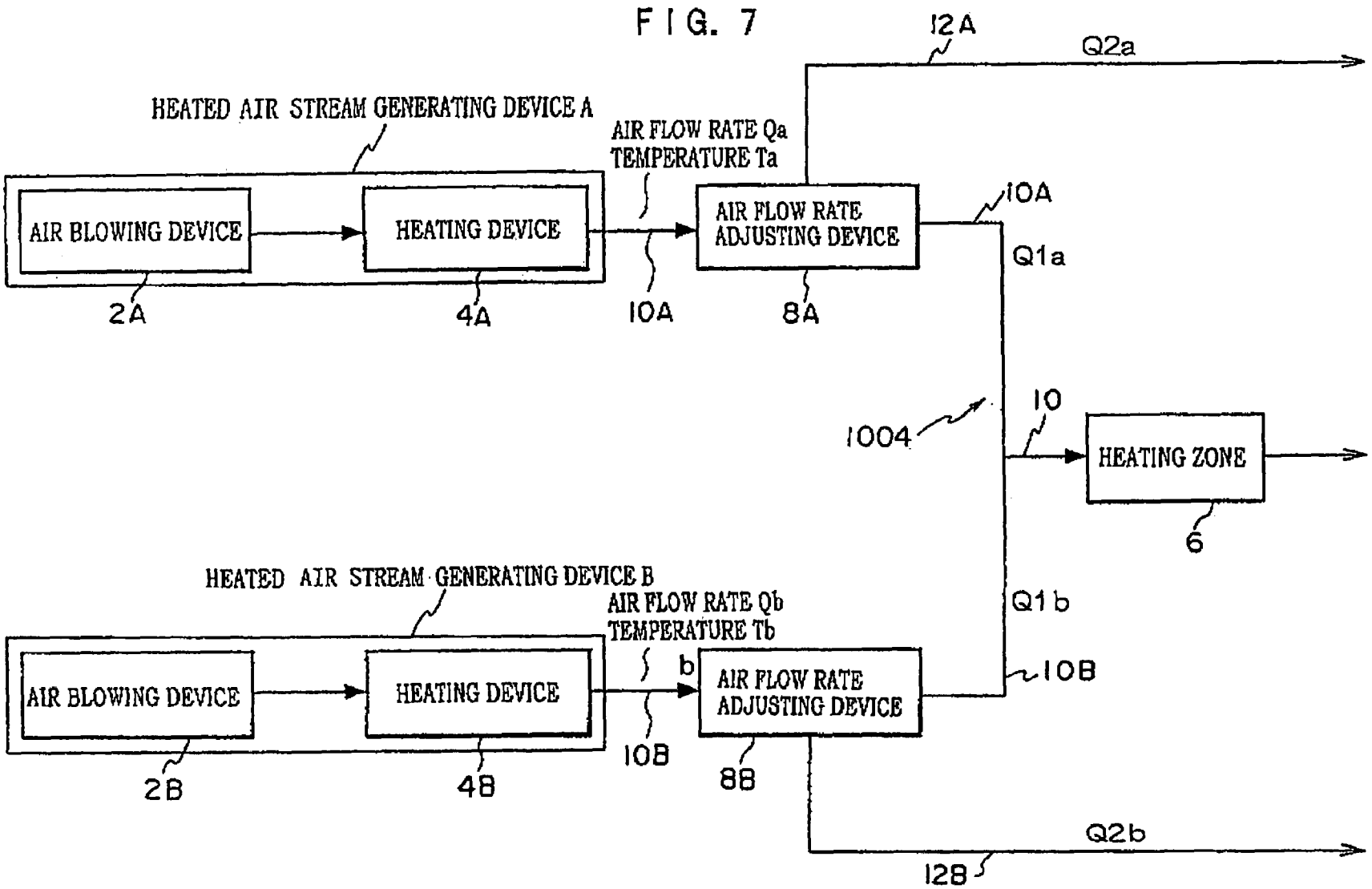
FIG. 7 is a schematic block diagram illustrating a constitution of the heating apparatus for a band-shaped body according to a third embodiment.

The heating apparatus for a band-shaped body 1004 according to a third embodiment has a heated air stream generating device A and a heated air stream generating device B as shown in FIG. 7.

The heated air stream generating device A includes an air blowing device 2A and a heating device 4A which are similar to the air blowing device 2 and the heating device 4. The heated air stream generating device B includes an air blowing device 2B and a heating device 4B similar to the air blowing device 2A and the heating device 4A in the heated air stream generating device A.

The heated air stream supply flow channel 10A and the heated air stream supply flow channel 10B are set between the heated air stream generating device A and the heating zone 6 and between the heated air stream generating device B and the heating zone 6, respectively. The heating air stream supply flow channels 10A and 10B join together just before the heating zone 6 so as to form the heated air stream supply flow channel 10.

The air flow rate adjusting device 8A is set on the heated air stream supply flow channel 10A, and the air flow rate adjusting device 8B is set on the heated air stream supply flow channel 10B. The air flow rate adjusting devices 8A and 8B are similar to the air flow rate adjusting device 8 explained in the first embodiment.

The heated air stream supply flow channels 10A and 10B correspond to the heated air stream supply flow channel in the heating apparatus for a band-shaped body of the invention. The air flow rate adjusting devices 8A and 8B correspond to the heated air stream introduction ratio adjusting unit in the band-shaped heating apparatus of the invention.

The air flow rate adjusting device 8A has a function for dividing the heated air stream generated by the heated air stream generating device A into an introduced air stream and an excess air stream. The introduced air stream is introduced into the heating zone 6. The excess air stream is discharged from an excess air stream discharge flow channel 12A branched from the air flow rate adjusting device 8A, out of the system of the heating apparatus for a band-shaped body 1004.

The air flow rate adjusting device 8B has a function for dividing the heated air stream generated by the heated air stream generating device B into introduced air stream and excess air stream. The introduced air stream is introduced into the heating zone 6, and the excess air stream is discharged from an excess air stream discharge flow channel 12B branched form the air flow rate adjusting device 8B, out of the heating apparatus for a band-shaped body 1004.

The function of the heating apparatus for a band-shaped body 1004 is explained below.

The heated air stream generating device A generates a heated air stream with air flow rate Qa and temperature Ta, and the heated air stream generating device B generates a heated air stream with air flow rate Qb and temperature Tb. The air flow rate Qa, the air flow rate Qb, the temperature Ta, and the temperature Tb are controlled so as to be constant. Further, the temperature Ta is higher than the temperature Tb.

The heated air stream with air flow rate Qa generated by the heated air stream generating device A is divided, into an introduced air stream with air flow rate Q1*a* and an excess air stream with air flow rate Q2*a*, by the air flow rate adjusting device 8A. Similarly, the heated air stream with air flow rate Qb generated by the heated air stream generating device B is divided, into an introduced air stream with air flow rate Q1*b* and an excess air stream with air flow rate Q2*b*, by the air flow rate adjusting device 8B.

In a case where an end of a band-shaped body with thickness t1 on the downstream side is joined to a band-shaped body with thickness t2 which is greater than the thickness t1: when the thickness t increases, of the band-shaped body to be introduced into the heating zone 6, the air flow rate adjusting devices 8A and 8B are controlled so that the air flow rate Q1*a* of the introduced air stream from the heated air stream generating device A increases, and the air flow rate Q1*b* of the introduction air stream form the heated air stream generating device B decreases. Since the temperature Ta of the introduced air stream from the heated air stream generating device A is higher than the temperature Tb of the introduced air stream from the heated air stream generating device B, the temperature of the introduced air stream to be introduced into the heating zone 6 rises, a quantity of heat supplied to the band-shaped body also increases.

In a case where an end of the band-shaped body with thickness t1 on the downstream side is joined to a band-shaped body with thickness t3 less than the thickness t1: when the thickness t decreases, of the band-shaped body introduced into the heating zone 6, the air flow rate adjusting devices 8A and 83 are controlled so that the air flow rate Q1*a* of the introduced air stream from the heated air stream generating device A decreases and the air flow rate Q1*b* of the introduced air stream from the heated air stream generating device 13 increases. As a result, the temperature of the introduced air stream to be introduced into the heating zone 6 decreases, and a quantity of heat supplied to the band-shaped body also decreases.

A mixing ratio of the introduced air stream from the heated air stream generating device A to the introduction air stream from the heated air stream generating device B is changed, so that the quantity of the heat supplied to the band-shaped body can be increased or decreased. When the air flow rate adjusting devices 8A and 8B are controlled, a ratio of the air flow rate Qa to the air flow rate Qb of the heated air stream from the heated air stream generating devices A and B is kept constant, and simultaneously the total air flow rate of the introduction air stream Q1 (=Q1*a*+Q1*b*) can be increased or decreased. For this reason, the heating conditions can be set more widely than that in the heating apparatus for a band-shaped body according to the first embodiment.

[Fourth Embodiment]

The heating apparatus for a band-shaped body according to a fourth embodiment is an example in which two air stream supply (feed) systems including an air stream supply (feed) system A and an air stream supply (feed) system B are switched, so that a quantity of the heat supplied to a band-shaped body passing through the heating zone is adjusted by the switching.

Figure 8:
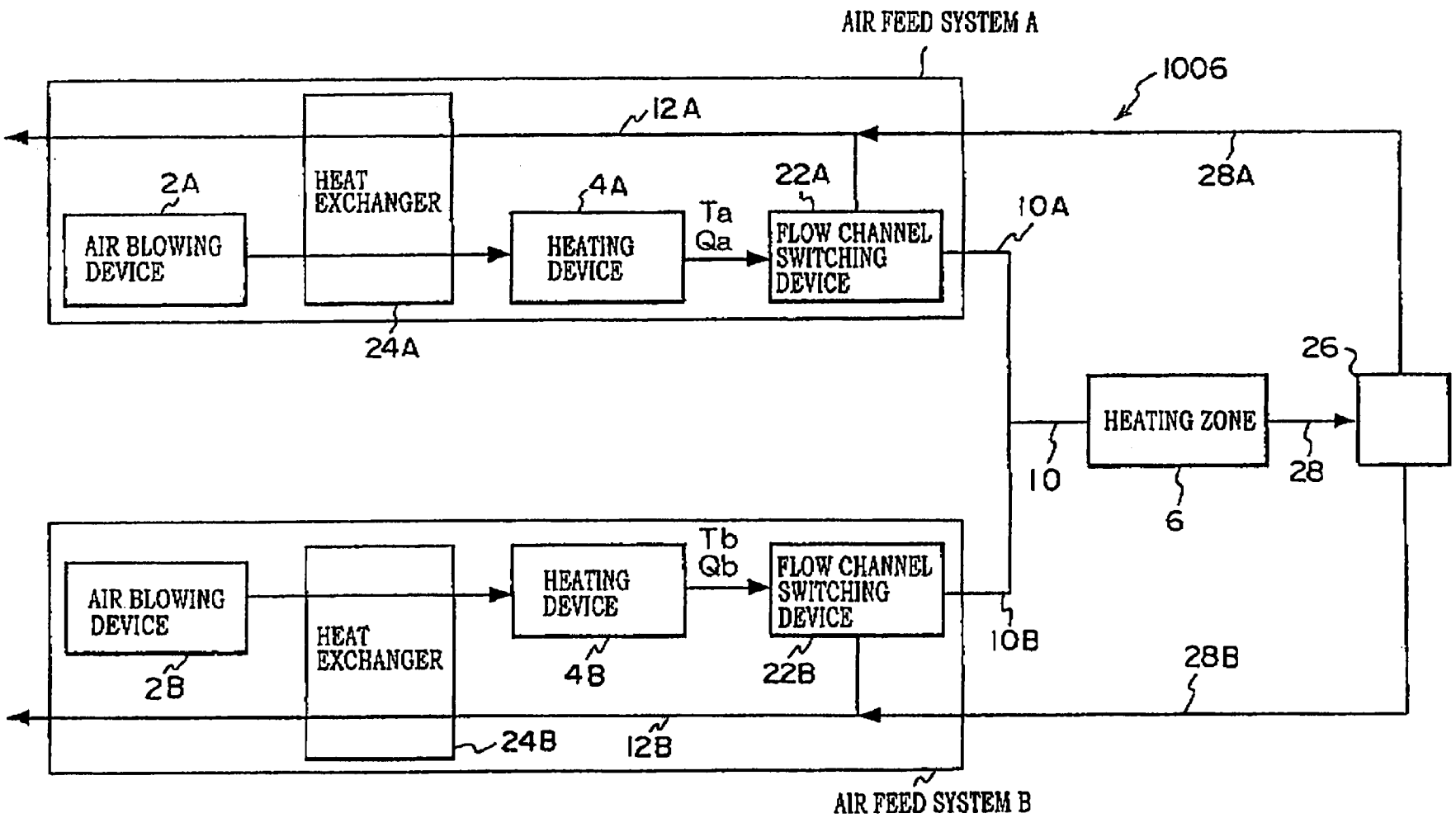
FIG. 8 is a schematic block diagram illustrating a constitution of the heating apparatus for a band-shaped body according to a fourth embodiment.

As shown in FIG. 8, the heating apparatus for a band-shaped body 1006 according to the fourth embodiment has the air stream supply (feed) system A and the air stream supply (feed) system B that introduce a heated air stream into a heating zone 6.

The air stream supply system A includes an air blowing device 2A, a heating device 4A, a heated air stream supply flow channel 10A, and an excess air stream discharge flow channel 12A. The air blowing device 2A generates an air stream. The heating device 4A heats the air stream generated by the air blowing device 2A so as to generate a heated air stream. The heated air stream supply flow channel 10A is used for introducing the heated air stream generated by the heating device 4A into the heating zone 6. The excess air stream discharge flow channel 12A is branched from a middle portion of the heated air stream supply flow channel 10A.

A flow channel switching device 22A is provided onto a portion where the excess air stream discharge flow channel 12A is branched from the heated air stream supply flow channel 10A. The flow channel switching device 22A switches the flow channel for the heated air stream generated by the heating device 4A between a first flow channel for supplying the heated air stream to the heating zone 6 via the heated air stream supply flow channel 10A and a second flow channel for discharging the heated air stream out of the system of the heating apparatus for a band-shaped body 1006 via the excess air stream discharge flow channel 12A.

A heat exchanger 24A is provided between the air blowing device 2A and the heating device 4A. The heat exchanger 24A exchanges heat between the air stream introduced from the air blowing device 2A into the heating device 4A and the excess air stream passing through the excess air stream discharge flow channel 12A.

The air stream supply system B has an air blowing device 2B, a heating device 4B, a heated air stream supply flow channel 10B, and an excess air stream discharge flow channel 12B. The air blowing device 2B generates an air stream. The heating device 4B heats the air stream generated by the air blowing device 2B so as to generate a heated air stream. The heated air stream supply flow channel 10B is used for introducing the heated air stream generated by the heating device 4B into the heating zone 6. The excess air stream discharge flow channel 12B is branched from a middle portion of the heated air stream supply flow channel 10B.

The flow channel switching device 22B is provided onto a portion where the excess air stream discharge flow channel 12B is branched from the heated air stream supply flow channel 10B. The flow channel switching device 22B switches the flow channel for the heated air stream generated by the heating device 4B between: a first flow channel for supplying the heated air stream to the heating zone 6 via the heated air stream supply flow channel 10B; and a second flow channel for discharging the heated air stream out of the system of the heating apparatus for a band-shaped body 1006 via the excess air stream discharge flow channel 12B.

The heat exchanger 24B is provided between the air blowing device 2B and the heating device 4B. The heat exchanger 24B exchanges heat between the air stream introduced from the air blowing device 2B into the heating device 4B and the excess air stream which passes through the excess air stream discharge flow channel 12B.

The air blowing device 2A, the heating device 4A, the air blowing device 2B, and the heating device 4B correspond to the heated air stream generating unit in the heating apparatus for a band-shaped body of the invention. The flow channel switching devices 22A and 22B correspond to a heated air stream supply flow channel switching unit in the heating apparatus for a band-shaped body. The heated air stream supply flow channels 10A and 10B correspond to the heated air stream supply flow channel in the heating apparatus for a band-shaped body of the invention.

The air blowing device 2A and the heating device 4A in the air stream supply system A are similar to the air blowing device 2 and the heating device 4 explained in the first embodiment. The air blowing device 2B and the heating device 4B in the air stream supply system B are similar to the air blowing device 2 and the heating device 4 explained in the first embodiment.

The heated air stream supply flow channels 10A and 10B join together just before the heating zone 6, so as to form the heated air stream supply flow channel 10.

A discharge air stream flow channel 28A and a discharge air stream flow channel 28B are provided on the downstream side of the heating zone 6. The discharged air stream flow channel 28A is used for introducing the discharged air stream discharged from the heating zone 6 into the excess air stream discharge flow channel 12A in the air stream supply system A. The discharged air stream flow channel 28B is used for introducing the discharged air stream discharged from the heating zone 6 into the excess air stream discharged flow channel 12B in the air stream supply system B.

A flow channel switching device 26 is provided between the heating zone 6 and the discharged air stream flow channels 28A and 28B. The flow channel switching device 26 switches the flow channel for the discharged air stream discharged from the heating zone 6 into any one of the discharged air stream flow channels 28A and 28B.

The function of the heating apparatus for a band-shaped body 1006 is explained below.

An end of a band-shaped body with thickness t1 on the downstream side is joined to a band-shaped body with thickness of t2, and the joined band-shaped body is allowed to pass through the heating zone 6 so as to be heated.

In the air stream supply system A, temperature Ta and air flow rate Qa of the heated air stream are set according to the thickness t1 of the band-shaped body on the downstream side of the joint portion. In the air stream supply system B, temperature Tb and air flow rate Qb of the heated air stream are set according to the thickness t2 of the band-shaped body on the upstream side of the joint portion.

When the portion of the band-shaped body on the upstream side of the joint portion passes through the heating zone 6, the flow channel switching device 22A is operated in the air stream supply system A so that the air blowing device 2A and the heating device 4A are communicatively connected with the heating zone 6 via the heated air stream supply flow channel 10A. The flow channel switching device 26 is switched so that the heating zone 6 is communicatively connected with the discharge air stream flow channel 28A. In contrast in the air stream supply system B, the flow channel switching device 22B is operated and stopped in a state so that the air blowing device 2B and the heating device 4B are communicatively connected with the excess air stream discharge flow channel 12B.

The heated air stream with temperature Ta and air flow rate Qa according to the thickness t1 is therefore, introduced from the air stream supply system A into the heating zone 6. The discharged air stream discharge from the heating zone 6 is discharged out of the system via the discharged air stream flow channel 28A and the excess air stream discharge flow channel 12A. At this time, however, the heat exchanger 24A exchanges heat between the discharged air stream and the air stream to be introduced from the air blowing device 2A into the heating device 4A so as to preheat the air stream.

When the joint portion of the band-shaped body nears the heating zone 6, the air stream supply system B is actuated so that the temperature Tb of the heated air stream is raised to Tb.

When the joint portion of the band-shaped body passes through the heating zone 6, the flow channel switching device 22A is operated in the air stream supply system A, so that the air blowing device 2A and the heating device 4A are communicatively connected with the excess air stream discharge flow channel 12A.

Meanwhile, in the air stream supply system B, the flow channel switching device 22B is operated so that the air blowing device 2B and the heating device 4B are communicatively connected with the heating zone 6 via the heated air stream supply flow channel 10B. At the same time, the flow channel switching device 26 is operated so that the heating zone 6 is communicatively connected with the discharge air stream flow channel 28B.

The temperature Tb and the air flow rate Qb according to the thickness t2 is introduced from the air stream supply system B into the heating zone 6. When the air stream supply system B is communicatively connected with the heating zone 6, the air stream supply system A is stopped.

In the heating apparatus for a band-shaped body 1006 according to the fourth embodiment, since the air flow rate and the temperature of the heated air stream can be freely set in the air stream supply systems A and B, the supplied heat quantity can be freely set according to the thickness of the band-shaped body which passes through the heating zone 6.

While the air stream supply system A is being operated, the air stream supply system B is stopped. Also the discharged air stream discharged from the heating zone 6 is introduced into the heat exchanger 24A or 24B so that the air stream to be introduced into the heating device 4A or 4B is preheated. For these reasons, the energy efficiency is high.

[Fifth Embodiment]

In the heating apparatus for a band-shaped body 1008 according to a fifth embodiment, the heating zone 6 is divided into a plurality of blocks, and the heated air stream is fed to each section.

Figure 9:
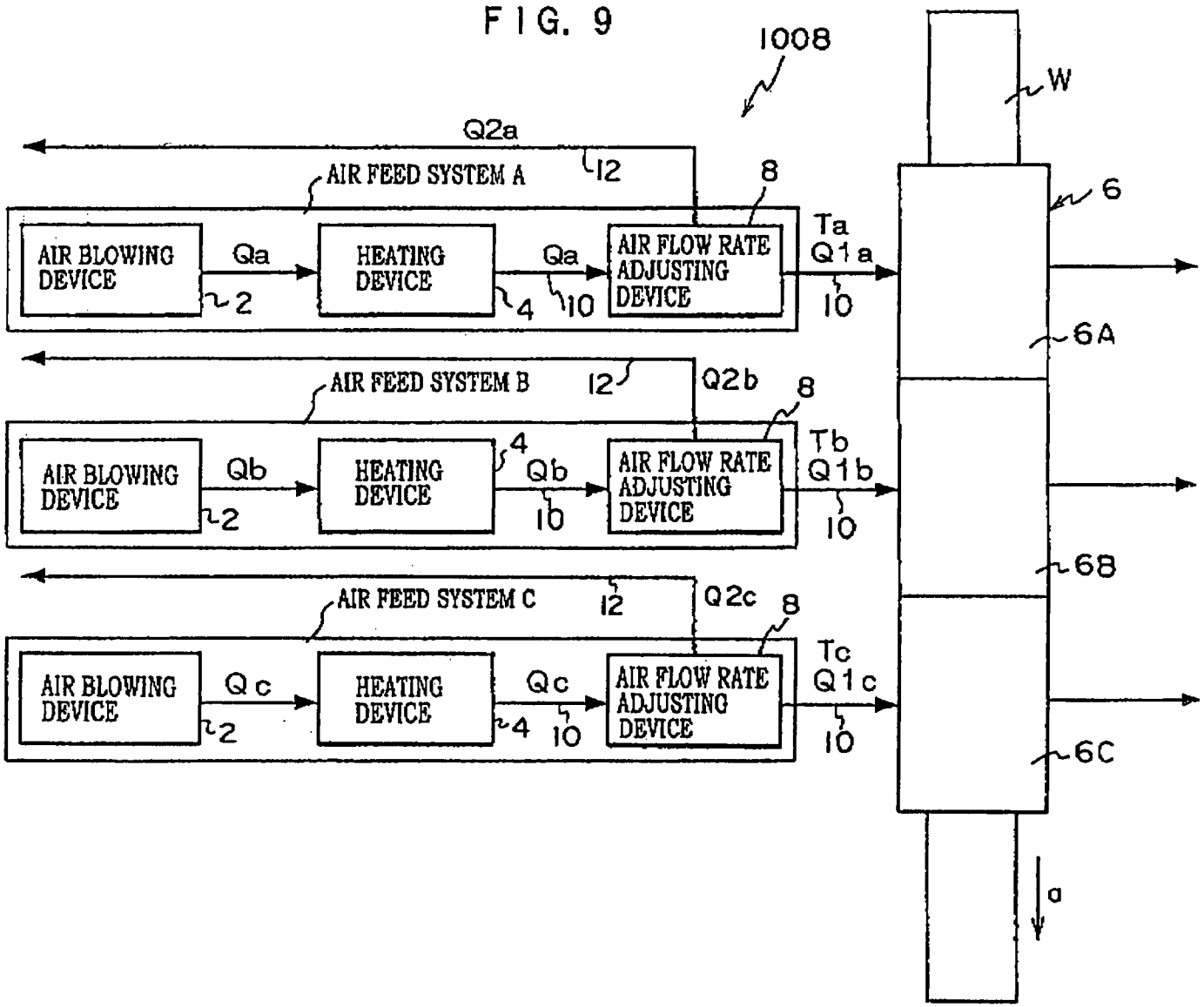
FIG. 9 is a block diagram illustrating a schematic constitution of the heating apparatus for a band-shaped body according to a fifth embodiment.

As shown in FIG. 9, the heating zone 6 of the heating apparatus for a band-shaped body 1008 is divided into three blocks, a block 6A, a block 6B, and a block 6C provided along a conveying direction "a" of a band-shaped body W from the upstream side to the downstream side. Those reference numerals in FIG. 9 that are the same as those in FIG. 1 designate elements that are the same as those in FIG. 1.

A heated air stream is fed from the air stream supply system A to the block 6A, from the air stream supply system B to the block 6B, and from the air stream supply system C to the block 6C.

The air stream supply systems A, B, and C include an air blowing device 2, a heating device 4, and an air flow rate adjusting device 8. The constitutions and the functions of the air blowing device 2, the heating device 4, and the air flow rate adjusting device 8 are as explained in the first embodiment.

In the air stream supply system A, the air blowing device 2 generates an air stream with air flow rate Qa, and the heating device 4 heats the air stream to temperature Ta so as to generate a heated air stream. In the air flow rate adjusting device 8, the heated air stream with temperature Ta and air flow rate Q1, generated by the air blowing device 2 and the heating device 4, is divided into introduced air stream with air flow rate Q1*a* and an excess air stream with air flow rate Q2*a*.

A sum of the air flow rate Q1*a* of the introduced air stream and the air flow rate Q2*a* of the excess air stream is Qa. The introduced air stream is fed to the block 6A via the heated air stream supply flow channel 10, and the excess air stream is discharged out of the heating apparatus for a band-shaped body 1008 via the excess air stream discharge flow channel 12.

In the air stream supply system B, a heated air stream with temperature Tb and air flow rate Qb is generated, and is separated into an introduced air stream with air flow rate Q1*b* and an excess air stream with air flow rate Q2*b*. The introduced air stream is fed to the block 6B via the heated air stream supply flow channel 10, and the excess air stream is discharged out of the band-shaped heating apparatus 1008 via the excess air stream discharge flow channel 12.

In the air stream supply system C, a heated air stream with temperature Tc and air flow rate Qc is generated, and is separated into an introduced air stream with air flow rate Q1*c* and an excess air stream with air flow rate Q2*c*. The introduction air stream is fed to the block 6C via the heated air stream supply flow channel 10, and the excess air stream is discharged out of the band-shaped heating apparatus 1008 via the excess air stream discharge flow channel 12.

The heated air stream with temperature Ta and air flow rate Q1*a* is supplied from the air stream supply system A to the block 6A of the heating zone, and the heated air stream with temperature Tb and air flow rate Q1*b* is supplied from the air stream supply system B to the block 6B of the heating zone. The heated air stream with temperature Tc and air flow rate Q1*c* is supplied from the air stream supply system C to the block 6C of the heating zone.

Figure 10:
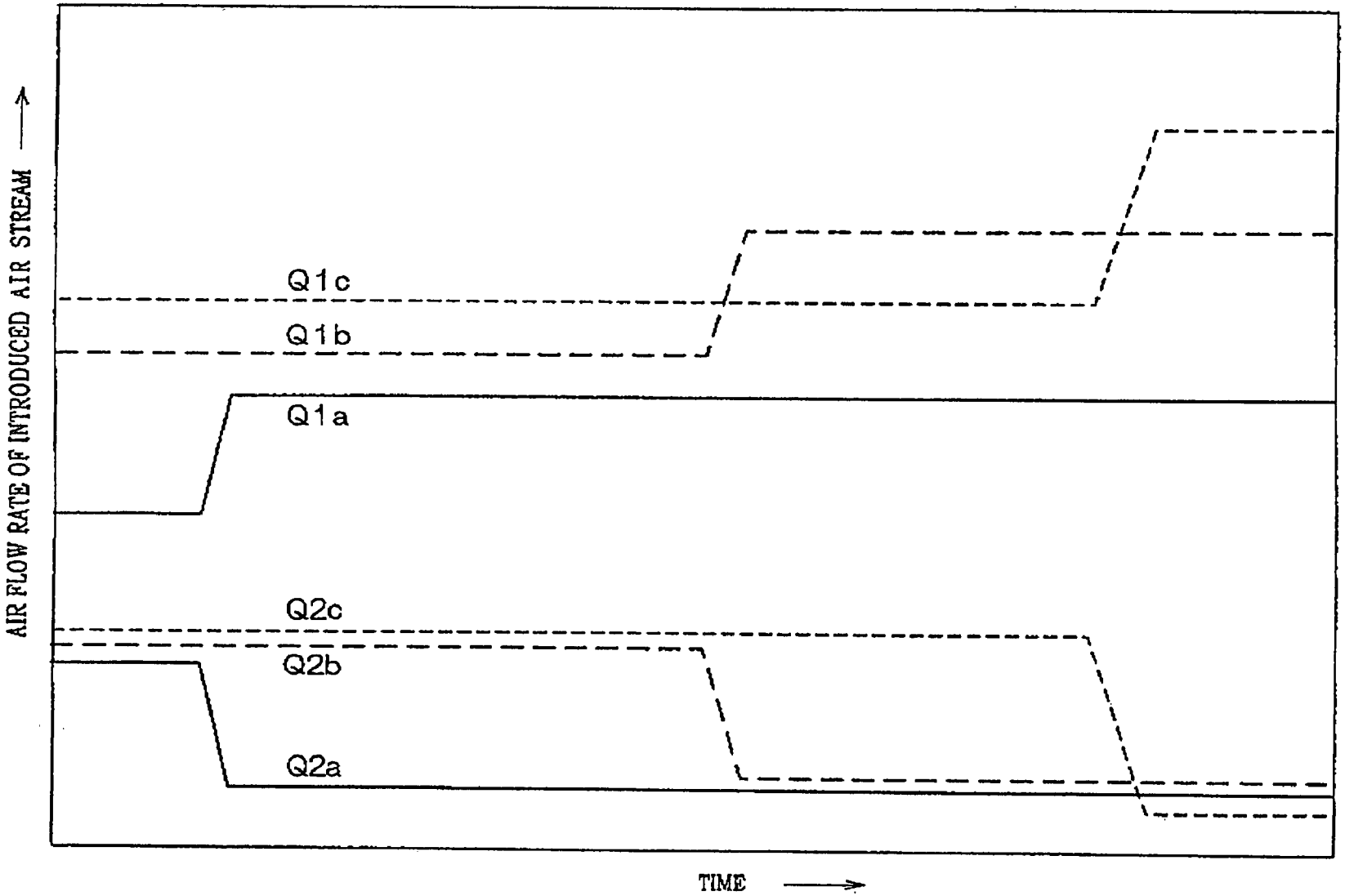
FIG. 10 is a graph illustrating changes in air flow rate with time of the introduced air stream, introduced into each block of the heating zone, and the excess air stream when the thickness of the band-shaped body is changed in the heating apparatus for a band-shaped body according to the fifth embodiment.

In a case where the thickness of the band-shaped body W changes at a middle portion, as in the case where an end of a band-shaped body with thickness t1 is joined to an end of a band-shaped body with thickness t2, when the joint portion of the band-shaped body W comes to each of the blocks of the heating zone 6, a ratio of the introduced air stream to the excess air stream is changed. That is to say, in the case, as shown in FIG. 10, where, for example, the thickness t2 is greater than the thickness t1, when the connected portion of the band-shaped body W comes to the block 6A, the air flow rate Q1*a* of the introduced air stream introduced from the air stream supply system A is increased.

When the connected portion of the band-shaped body W comes to the block 6B, the air flow rate Q1*b* of the introduced air stream introduced from the air stream supply system B is increased. When the connected portion of the band-shaped body W comes to the block 6C, the air flow rate Q1*c* of the introduced air stream introduced from the air stream supply system C is increased.

As a result, the surface temperature of the band-shaped body in the blocks 6A, 6B, and 6C is maintained constant.

There are occasions where a band-shaped body is heated in a step like fashion with heating at different temperatures. For example, when a CTP printing plate is manufactured, a plate-making layer forming liquid is applied to a roughened surface of a support web, which is then heated and dried so that the making plate layer is formed, and this layer is annealed.

The heating apparatus for a band-shaped body 1008 according to the fifth embodiment controls the air stream supply systems A, B, and C independently, so that the supplied heat quantity in the blocks 6A, 6B, and 6C can be varied independently. For this reason, the blocks 6A, 6B, and 6C can be easily maintained at different temperatures. By passing the band-shaped body W successively through the blocks 6A, 6B, and 6C the band-shaped body W is automatically processed at different temperatures in a step like fashion.

[Sixth Embodiment]

Another example of the heating apparatus for a band-shaped body which supplies a heated air stream to divided blocks of a heating zone is explained below.

Figure 11:
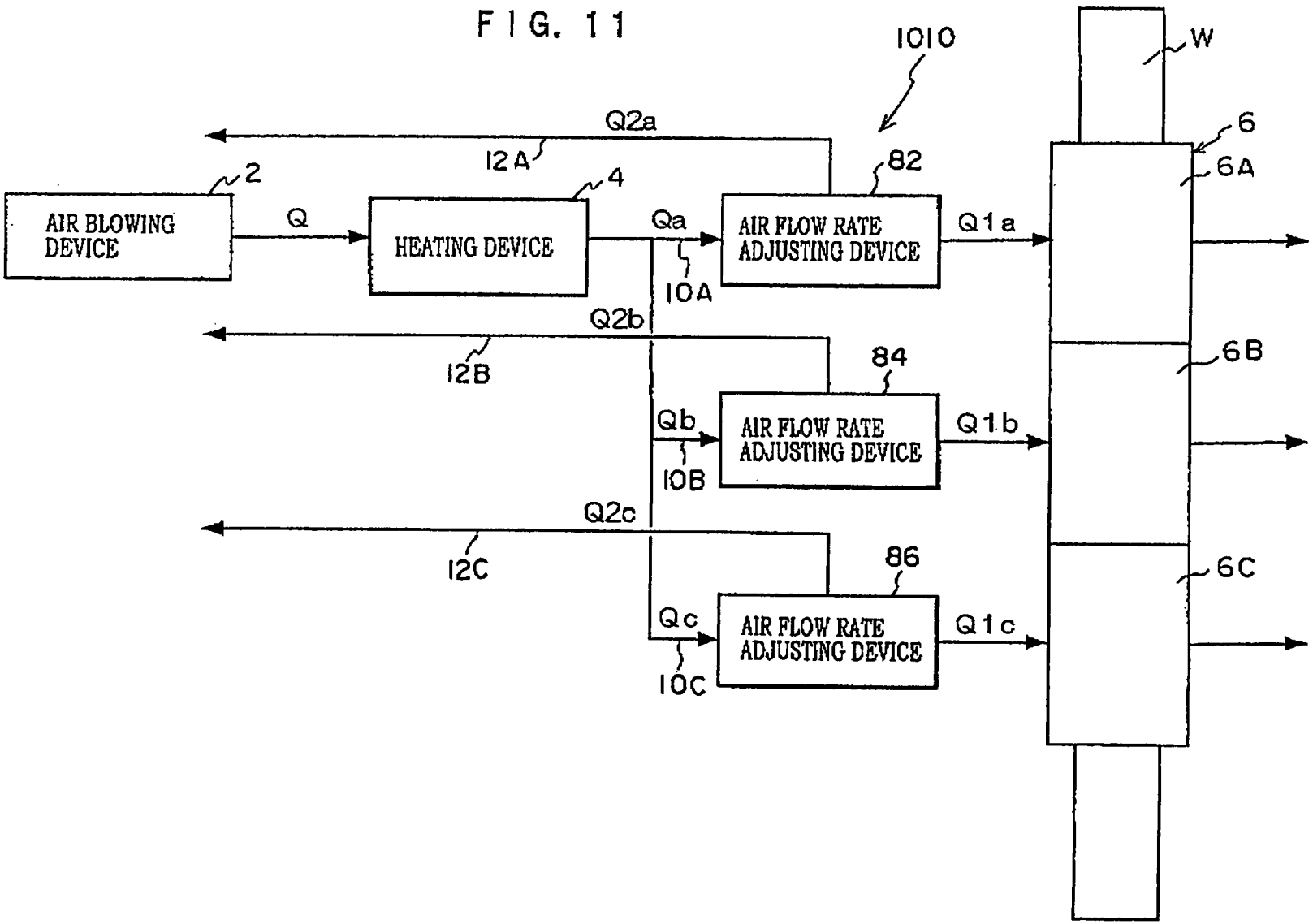
FIG. 11 is a schematic block diagram illustrating a constitution of the heating apparatus for a band-shaped body according to a sixth embodiment.

As shown in FIG. 11, in the heating apparatus for a band-shaped body 1010 according to a sixth embodiment, similarly to the heating apparatus for a band-shaped body 1008 of the fifth embodiment, the heating zone 6 is divided into three blocks: blocks 6A, 6B, and 6C.

One air blowing device 2 and one heating device 4 are provided.

The heated air stream supply flow channel 10A for supplying the heated air stream to the block 6A, the heated air stream supply flow channel 10B for supplying the heated air stream to the block 6B, and the heated air stream supply flow channel 10C for supplying the heated air stream to the block 6C are provided between the heating device 4 and the heating zone 6.

The air flow rate adjusting devices 82, 84 and 86 are provided on the heated air stream supply flow channels 10A, 10B and 10C respectively, and divide the heated air stream introduced from the heating device 4 into: the introduced air streams to be introduced into the blocks 6A, 6B and 6C; and the excess air streams to be discharged out of the system of the heating apparatus for a band-shaped body 1010.

The excess air stream discharge flow channels 12A, 12B, and 12C for discharging the excess air stream are branched from the heated air stream supply flow channels 10A, 10B, and 10C, respectively. The air flow rate adjusting devices 82, 84, and 86 correspond to the heated air stream introduction ration adjusting unit provided to the heating apparatus for a band-shaped body of the invention.

The function of the heating apparatus for a band-shaped body 1010 is explained below.

The heated air stream with temperature T and air flow rate Q generated by the air blowing device 2 and the heating device 4 are introduced into the air flow rate adjusting devices 82, 84, and 86 at air flow rates of Qa, Qb, and Qc, via the heated air stream supply flow channels 10A, 10B, and 10C respectively.

In the air flow rate adjusting device 82, the heated air stream with air flow rate Qa is divided into an introduced air stream with air flow rate Q1*a* and an excess air stream with air flow rate Q2*a*. The introduced air stream is introduced into the block 6A of the heating zone 6 through the heated air stream supply flow channel 10A.

Similarly, in the air flow rate adjusting devices 84 and 86, the heated air streams with air flow rates Qb and Qc are divided respectively into: an introduced air stream with air flow rate Q1*b* and an excess air stream with air flow rate Q2*b*; and an introduced air stream with air flow rate Q1*c* and excess air stream with air flow rate Q2*c*.

The introduced air stream divided by the air flow rate adjusting device 84 is introduced into the block 6B via the heated air stream supply flow channel 10B, and the introduced air stream divided by the air flow rate adjusting device 86 is introduced into the block 6C via the heated air stream supply flow channel 10C.

When the heating temperature of the band-shaped body W is to differ in the blocks 6A, 6B, and 6C, the air flow rate of the introduced air streams to be introduced into the respective blocks is increased or decreased so that the temperature of the blocks 6A, 6B, and 6C can be controlled. That is to say, the air flow rate adjusting devices 82, 84, and 86 are controlled so that the air flow rate of the introduced air stream becomes greater in a block with higher heating temperature.

In the case of a band-shaped body W where an end of a band-shaped body with thickness t1 is joined to a band-shaped body with thickness t2, similar to the heating apparatus for a band-shaped body 1008 according to the fifth embodiment, every time a joint portion of the band-shaped body W comes to the blocks 6A, 6B, and 6C, the air flow rate adjusting devices 82, 84, and 86 are controlled. As a result, the air flow rates Q1*a*, Q1*b*, and Q1*c* of the introduced air streams are increased or decreased so that the supplied heat quantity is changed, and the temperature history of the band-shaped body W is constant on the upstream and downstream sides of the joined portion.

The heating apparatus for a band-shaped body 1010 of the sixth embodiment has only one air blowing device 2 and one heating device 4 with large energy consumptions. For this reason, in addition to having the characteristics of the band-shaped heating apparatus 1008 according to the fifth embodiment, the energy efficiency in the apparatus 1010 is greater.

[Seventh Embodiment]

Still another example of the heating apparatus for a band-shaped body which supplies a heated air stream to divided blocks of a heating zone is explained below.

Figure 12:
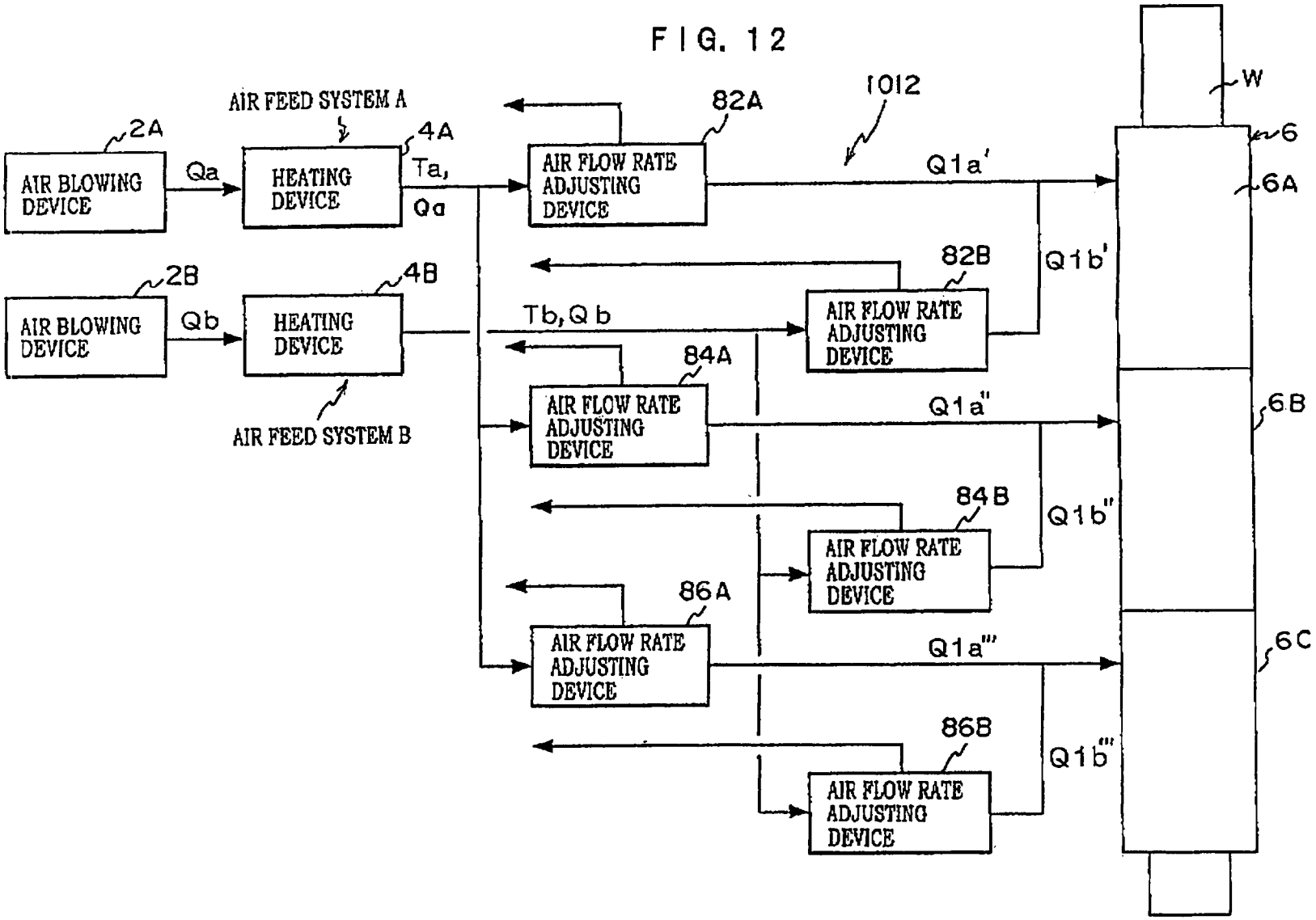
FIG. 12 is a schematic block diagram illustrating a constitution of the heating apparatus for a band-shaped body according to a seventh embodiment.

As shown in FIG. 12, in the heating apparatus for a band-shaped body 1012 according to a seventh embodiment, similarly to the heating apparatus for a band-shaped body 1008 in the fifth embodiment, the heating zone 6 is divided into three blocks, blocks 6A, 6B, and 6C.

Air stream supply systems A and B are connected to the blocks 6A, 6B, and 6C.

The air stream supply system A includes an air blowing device 2A, a heating device 4A, air flow rate adjusting devices 82A and 84A, and 86A. The air blowing device 2A and the heating device 4A generate a heated air stream. The air flow rate adjusting device 82A adjusts the air flow rate of the heated air stream, generated by the air blowing device 2A and the heating device 4A, to be fed to the block 6A. The air flow rate adjusting device 84A adjusts the air flow rate of the heated air stream, generated by the air blowing device 2A and the heating device 4A, to be fed to the block 6B. The air flow rate adjusting device 86A adjusts the air flow rate of the heated air stream, generated by the air blowing device 2A and the heating device 4A, to be fed to the block 6C.

The air blowing device 2A, the heating device 4A, the air flow rate adjusting devices 82A, 84A, and 86A are the same as the air blowing device 2, the heating device 4, the air flow rate adjusting devices 82, 84, and 86 explained in the sixth embodiment.

Similarly the air stream supply system B includes an air blowing device 2B, a heating device 4B, and air flow rate adjusting devices 82B and 84B, and 86B. The air blowing device 2B and the heating device 4B generate a heated air stream. The air flow rate adjusting device 82B adjusts the air flow rate of the heated air stream, generated by the air blowing device 2B and the heating device 4B, to be fed to the block 6A. The air flow rate adjusting device 84B adjusts the air flow rate of the heated air stream, generated by the air blowing device 2B and the heating device 4B, to be fed to the block 6B. The air flow rate adjusting device 86B adjusts the air flow rate of the heated air stream, generated by the air blowing device 2B and the heating device 4B, to be fed to the block 6C.

The air blowing device 2B, the heating device 4B, the air flow rate adjusting devices 82B, 84B, and 86B are the same as the air blowing device 2, the heating device 4, the air flow rate adjusting devices 82, 84, and 86 explained in the sixth embodiment.

Hereinafter, the air blowing devices 2A and 2B are generally called "the air blowing device 2", and the heating devices 4A and 4B are generally called as "the heating device 4". This referencing method is similarly applied also to the air flow rate adjusting devices 82A and 82B, the air flow rate adjusting devices 84A and 84B, and the air flow rate adjusting devices 86A and 86B.

The function of the heating apparatus for a band-shaped body 1012 is explained below.

In the air stream supply system A, the air blowing device 2A and the heating device 4A generate a heated air stream with air flow rate Qa and temperature Ta. In the air stream supply system B, the air blowing device 2B and the heating device 4B generate a heated air stream with air flow rate Qb and temperature Tb. The air flow rate Qa may be equal to or different from the air flow rate Qb, however, the temperature Ta is different from the temperature Tb. In this case, the temperature Ta is higher than the temperature Tb.

In the air stream supply system A, the air flow rate adjusting device 82A adjusts the air flow rate of the heated air stream, with air flow rate Qa and temperature Ta generated by the air blowing device 2A and the heating device 4A, to an air flow rate of Q1*a*' for introducing into the block 6A. Similarly, the air flow rate adjusting device 84A adjusts the air flow rate of the heated air stream to an air flow rate of Q1*a*" for introducing into the block 6B. The air flow rate adjusting device 86A adjusts the air flow rate of the heated air stream to an air flow rate of Q1*a*'" for introducing into block 6C.

In the air stream supply system B, the air flow rate adjusting device 82B adjusts the air flow rate of a heated air stream, with air flow rate Qb and temperature Tb generated by the air blowing device 2B and the heating device 4B, to an air flow rate of Q1*b*', for introduction into block 6A. Similarly, the air flow rate adjusting device 84B adjusts the air flow rate of the heated air stream to Q1*b*" so as to introduce the heated air stream to the block 6B. The air flow rate adjusting device 86B adjusts the air flow rate of the heated air stream to Q1*b*'" so as to introduce the heated air stream to the block 6C.

The heated air stream is, therefore supplied from the air stream supply systems A and B to the block 6A at air flow rate Q1*a* (=air flow rate Q1*a*'+air flow rate Q1*b*'). The heated air stream is fed to the block 6B at air flow rate Q1*b* (=Q1*a*"+Q1*b*"), and the heated air stream is fed to the block 6C at air flow rate Q1*c* (=Q1*a*'"+Q1*b*'").

The temperature of the heated air stream T1*a* in the block 6A is obtained by (Ta·Q1*a*'+Tb·Q1*b*')/Q1*a*. The temperature T1*b* in the block 6B is obtained by (Ta·Q1*a*"+Tb·Q1*b*")/Q1*b*. The temperature T1*c* in the block 6C is obtained by (Ta·Q1*a*'"+Tb·Q1*b*'")/Q1*c*.

In the heating apparatus for a band-shaped body 1012 of the seventh embodiment, the air flow rate adjusting devices 82, 84 and 86 are controlled in the air stream supply systems A and B so that a mixing ratio of the heated air stream generated in the air stream supply systems A and B is adjusted. Further, the air blowing device 2 and the heating device 4 are controlled so that the temperature and the air flow rate of the heated air streams to be generated can be controlled.

The supplied heat quantity can therefore be finely controlled according to the temperature set for the blocks 6A, 6B, and 6C and width and thickness of the passing band-shaped body W. For this reason, even in a band-shaped body obtained by connecting two band-shaped body with differing thicknesses, the temperature history can be maintained constant with a high accuracy.

[Eighth Embodiment]

An example of the heating apparatus for a band-shaped body having a joint portion detecting unit and a production management information storage unit is explained below.

Figure 13:
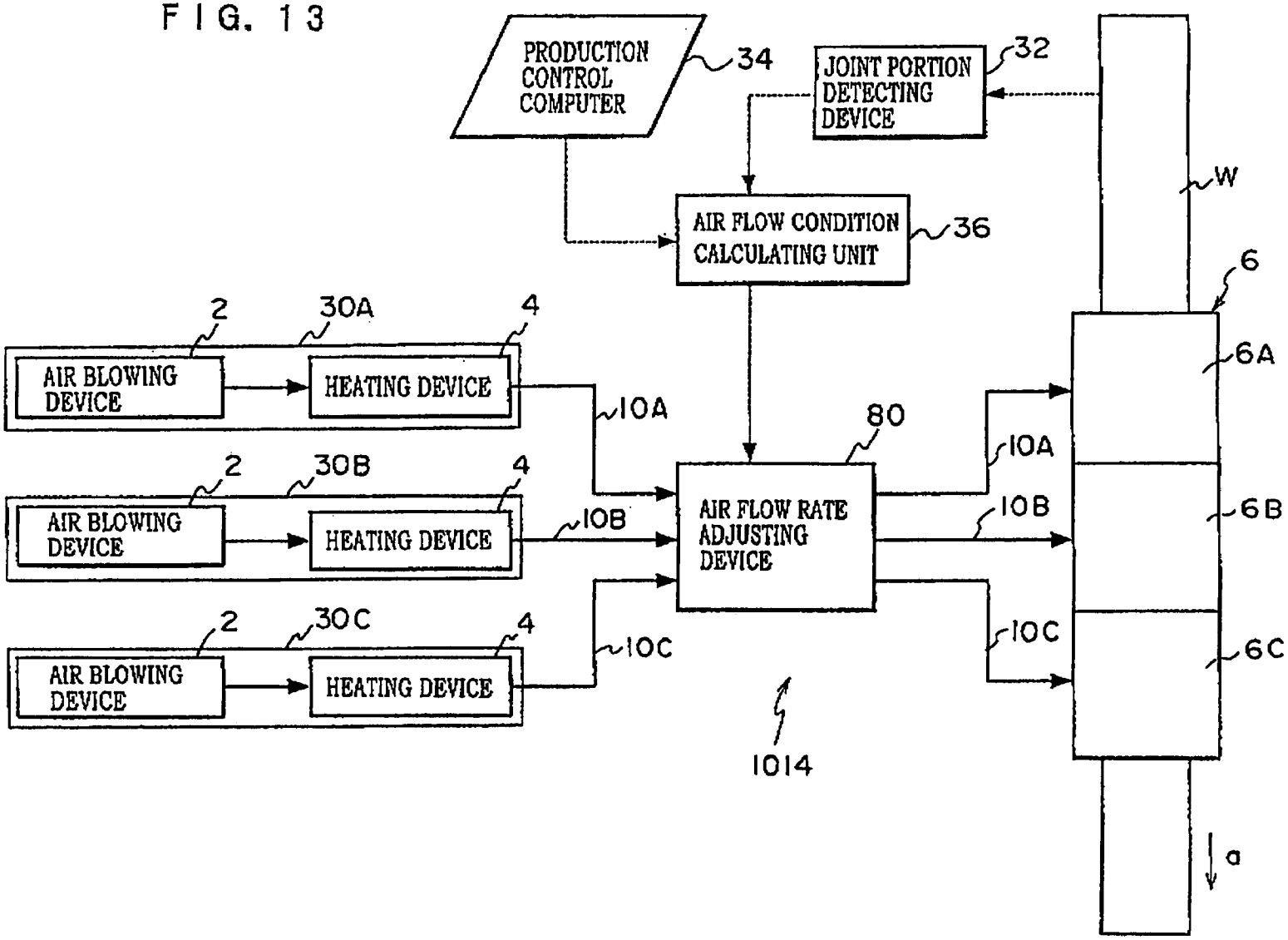
FIG. 13 is a schematic block diagram illustrating a constitution of the heating apparatus for a band-shaped body according to an eighth embodiment.

The heating apparatus for a band-shaped body 1014 according to an eighth embodiment includes heated air stream generating devices 30A, 30B, and 30C, heated air stream supply flow channels 10A, 10B, and 10C, and an air flow rate adjusting device 80 as shown in FIG. 13. The heated air stream generating devices 30A, 30B and 30C generate heated air streams. The heated air stream supply flow channels 10A, 10B and 10C are used for introducing the heated air streams generated by the heated air stream generating devices 30A, 30B and 30C into the blocks 6A, 6B and 6C of the heating zone 6. The air flow rate adjusting device 80 adjusts the air flow rate of the heated air stream passing through the heated air stream supply flow channels 10A, 10B and 10C so as to control the quantity of heat to be fed to the blocks 6A, 6B and 6C.

The heating apparatus for a band-shaped body 1014 further includes a joint portion detecting device 32, a production control computer 34, an air flow condition operating unit 36. The joint portion detecting device 32 is provided near the inlet of the heating zone 6 and detects joint portions of the band-shaped body W conveyed through the heating zone 6 along the conveying direction "a". The production control computer 34 stores production management information relating to the width and the thickness of the band-shaped body W therein. The air flow condition operating unit 36 controls the air flow rate adjusting device 80 based on inputs from the joint portion detecting device 32 and the production control computer 34.

Examples of the joint portion detecting device 32 are: a device that optically detects the joint portion; a device that mechanically detects the joint portion; a device that emits an electromagnetic wave so as to detect the joint portion, based on a change in a time from irradiation of the electromagnetic wave to the time of its return after reflection by the band-shaped body; and a device that detects the joint portion based on a change in electrical characteristics, such as a resistance value and electrostatic capacity.

The heated air stream generating devices 30A, 30B and 30C correspond to the heated air stream generating unit provided to the heating apparatus for a band-shaped body of the invention. The heated air stream supply flow channels 10A, 10B and 10C correspond to the heated air stream supply flow channel provided to the heating apparatus for a band-shaped body of the invention. The air flow rate adjusting device 80 corresponds to the heated air flow rate adjusting unit provided to the heating apparatus for a band-shaped body of the invention. The joint portion detecting device 32, the production control computer 34, and the air flow condition operating unit 36 correspond to the joint portion detecting unit, the production management information storage unit, and the control unit in the heating apparatus for a band-shaped body of the invention, respectively.

The function of the heating apparatus for a band-shaped body 1014 is explained below.

The air flow condition operating unit 36 reads a thickness of the band-shaped body on the downstream side of the joint portion from the production control computer 34 until the joint portion detecting device 32 detects the joint portion of the band-shaped body W. The air flow condition controlling unit 36 controls the air flow rate adjusting device 80 based on the thickness. The heated air streams with air flow rates according to the read thickness are supplied from the heated air stream generating devices 30A, 30B and 30*c* to the heated air stream supply flow channels 10A, 10B and 10C respectively.

When the joint portion detecting device 32 detects the joint portion of the band-shaped body W, the air flow condition operating unit 36 reads the thickness of the band-shaped body on the upstream side of the joint portion from the production control computer 34. The air flow condition controlling unit 36 controls the air flow rate adjusting device 80 so that the heated air streams with air flow rates according to the read thickness are supplied to the heated air stream supply flow channels 10A, 10B and 10C.

[Ninth Embodiment]

Figure 14:
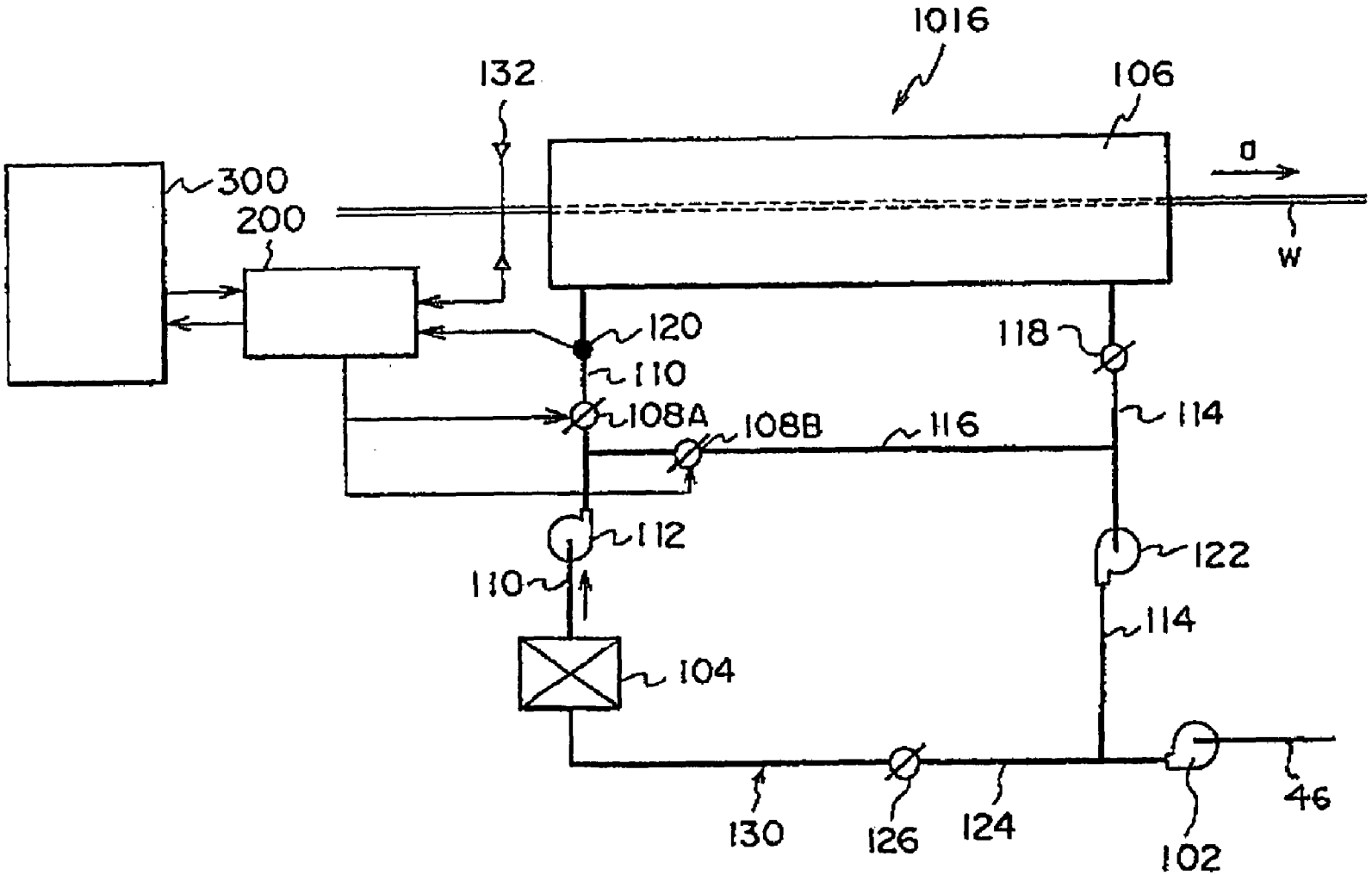
FIG. 14 is a schematic block diagram illustrating a constitution of a drying line according to a ninth embodiment.

FIG. 14 is a schematic diagram illustrating a constitution of a drying line as an example where the heating apparatus for a band-shaped body of the invention is applied to the manufacturing of planographic printing plates.

As shown in FIG. 14, the drying line 1016 according to a ninth embodiment includes one example of a line for drying a band-shaped body, and includes a heating zone 106, a heated air stream generating device 130, a heated air stream supply flow channel 110, a bypass flow channel 116, and a return flow channel 114. The heating zone 106 is for drying using a heated air stream a plate-making layer forming liquid applied to a support web W conveyed in a conveying direction "a". The heated air stream generating device 130 generates the heated air stream to be introduced into the heating zone 106. The heated air stream supply flow channel 110 is used for introducing the heated air stream generated by the heated air stream generating device 130 into the heating zone 106. The bypass flow channel 116 is branched from the heated air stream supply flow channel 110 and bypasses the heated air stream generated by the heated air stream generating device 130. The return flow channel 114 is used for returning discharge air stream discharged from the heating zone 106 to the heated air stream generating device 130.

The heated air stream generating device 130 has a blower 102, a heater 104, an air stream supply flow channel 124, and an auxiliary blower 112. The blower 102 sucks in outside air (fresh air) so as to generate an air stream. The heater 104 heats the air stream generated by the blower 102. The air stream supply flow channel 124 is used for supplying the air stream generated by the blower 102 to the heater 104. The auxiliary blower 112 is set on the heated air stream supply flow channel 110 on the downstream side of the heater 104. The return flow channel 114 is communicatively connected with the air stream supply flow channel 124.

A variable damper 108A and a variable damper 108B are set on the heated air stream supply flow channel 110 and the bypass flow channel 116, respectively. A variable damper 118 is set on the return flow channel 114.

A variable damper 126 is set on the air stream supply flow channel 124. The variable dampers 108A, 108B, 118 and 126 have variable openings.

The heated air stream supply flow channel 110 further has an air flow rate sensor 120 that detects an air flow rate of heated the air stream to be introduced into the heating zone 106. A second auxiliary blower 122 is provided near the air stream supply flow channel 124 on the return flow channel 114.

For the heater 104, an electric heater, a gas heater, various combustion heaters and the like are used.

The blower 102 and the heater 104 correspond to an air stream generating unit and a heating unit provided to the heating apparatus for a band-shaped body of the invention. The heating zone 106 corresponds to the heating zone provided to the heating apparatus for a band-shaped body of the invention. The variable dampers 108A and 108B correspond to the heated air flow rate adjusting unit provided to the heating apparatus for a band-shaped body, and the heated air stream supply flow channel 110 corresponds to the heated air stream supply flow channel provided to the heating apparatus for a band-shaped body.

A joint portion detecting sensor 132 which detects the joint portion of the support web W is provided near the inlet of the heating zone 106. The joint portion detecting sensor 132 corresponds to a dimension detecting device provided to the heating apparatus for a band-shaped body of the invention. For the joint portion detecting sensor 132, an optical sensor which optically detects the joint portion, a mechanical sensor which mechanically detects the joint portion, an electrical sensor which electrically detects the joint portion, and the like can be used.

The drying line 1016 further includes a control computer 200 that controls opening of the variable dampers 108A and 108B based on an input from the joint portion detecting device 132. The control computer 200 is connected with a production control computer 300. The control computer 200 correspond to a control unit provided to the heating apparatus for a band-shaped body of the invention respectively.

The capacity of the heater 104 can be determined based on the following procedure, for example.

The support web W has width w (m), specific heat σ (kcal/$m^3$·° C.), thickness t1 (m) on the downstream side of the joint portion, and thickness t2 (m) on the upstream side of the joint portion, and it is conveyed in the conveying direction "a" at a conveying speed v (m/min). When an increase in temperature from room temperature of the support web in the heating zone 106 is Δt(° C.), an air flow rate of the heated air stream passing through the heating zone 106 is V1 ($m^3$/min), and an air flow rate of a fresh air stream to be introduced from a fresh air stream supply flow channel 46 is V2 ($m^3$/min), a change in heating load Δq (kcal/min) which is a change in the heating load necessary for raising the temperature of the support web W from room temperature by a temperature Δt is obtained according to the following equation:

$$\Delta q=\sigma\cdot w\cdot v\cdot\Delta t\cdot(t2-t1)\cdot(1-V2/V1).$$

A heating capacity Q of the heater 104 and the air flow rate V2 of the fresh air to be introduced can be determined based on the above equation so that a change rate of the heating load Δq/Q (Q is the heating capacity (kcal/min) of the heater 104) falls-within a predetermined range, for example, within 10%.

Figure 15:
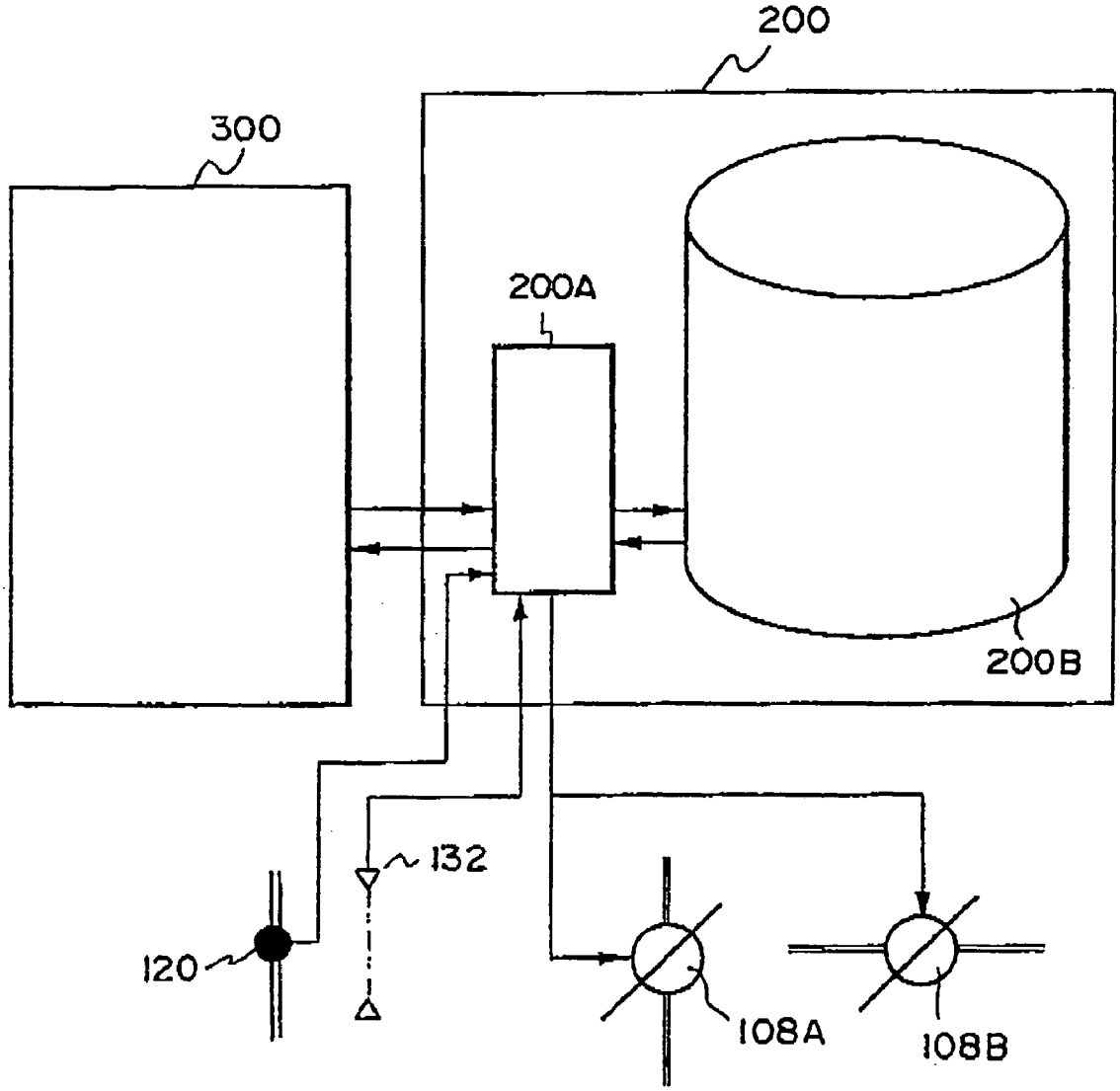
FIG. 15 is a schematic block diagram illustrating a constitution of a control computer provided to the drying line shown in FIG. 14.

As shown in FIG. 15, the control computer 200 includes a storage device 200B and a central processing unit 200A. The storage device 200B stores temperature history data relating to the thickness of various support webs and represents relationships between a distance from the inlet of the heating zone 106, namely a drying length, and the temperature of the support web W. The central processing unit 200A receives the input signals from the joint portion detecting sensor 132 and the supply air flow rate sensor 120 therein, and reads the thickness and width of the support web W on the upstream side and the downstream side of the joint portion from the production control computer 300. The central processing unit 200A further reads the temperature history data related to the read thickness and width of the support web from the storage device 200B, and controls the opening of the variable dampers 108A and 108B based on the temperature history data.

Figure 16:
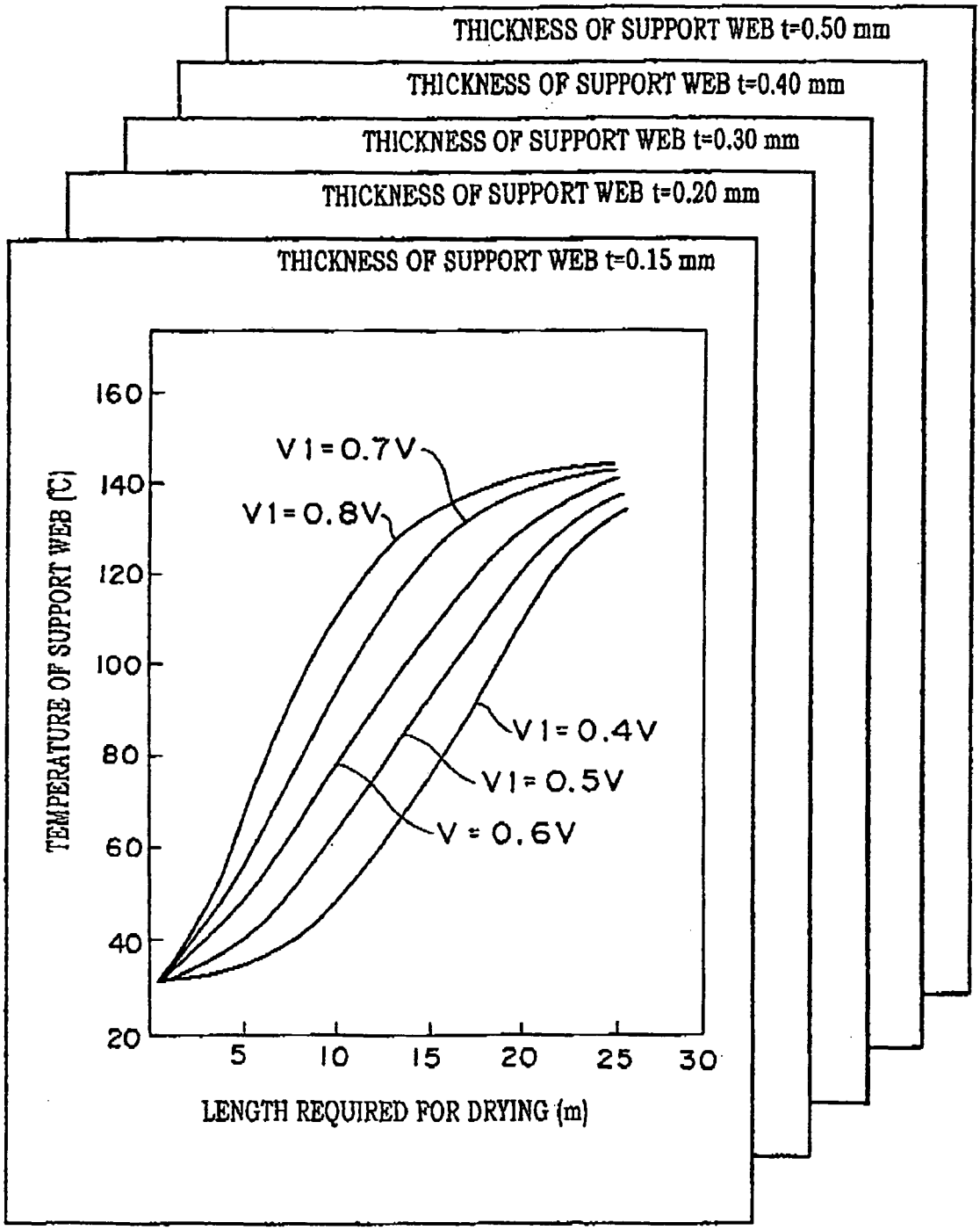
FIG. 16 is a graph illustrating one example of temperature history data stored in a storage device of the control computer shown in FIG. 15.

FIG. 16 shows one example of the temperature history data stored in the storage device 200B of the control computer 200. In FIG. 16, V ($m^3$/min) is an air flow rate of the heated air stream passing through the heater 104 in such a circulating flow channel as shown in FIG. 14.

As shown in FIG. 16, the temperature history data was obtained as curved line groups which represent the relationship between a drying length L (m) within the heating zone 106 and the temperature T (° C.) of the support web W. At this time, the support web W had a width of 1 m and its thickness t was 0.15 mm, 0.20 mm, 0.30 mm, 0.40 mm, and 0.50 mm, and the air flow rate V1 of the heated air stream passing through the heating zone 106 was changed within a range of 0.4 V to 0.8 V. When the support web had width w (m), the air flow rate V1 obtained from the graph can be multiplied by w, to obtain a similar graph.

Figure 17:
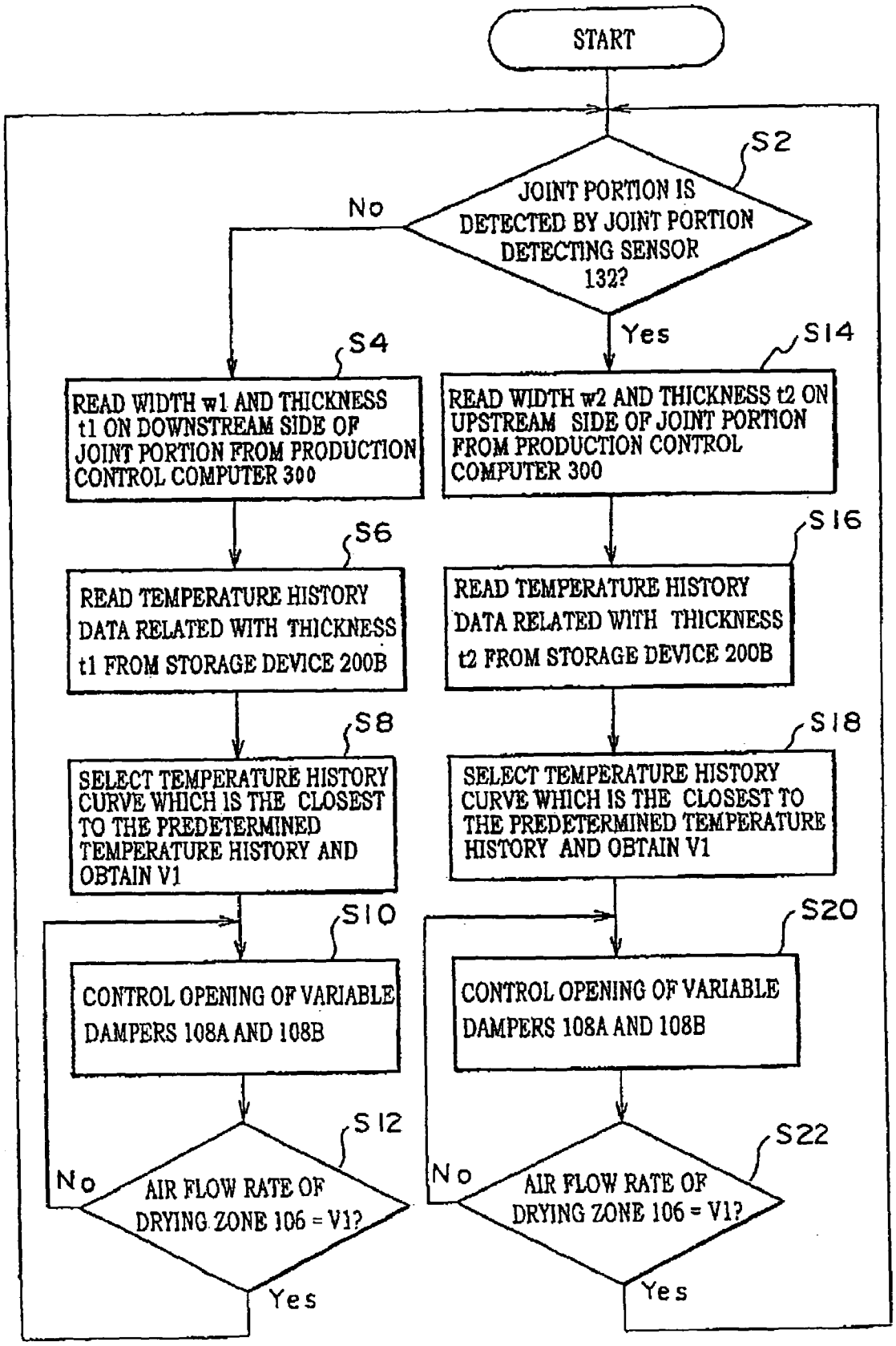
FIG. 17 is a flowchart illustrating an operating procedure of the drying line shown in FIG. 14.

The function of the drying line 1016 will be explained by using a flowchart as in FIG. 17.

A determination is made whether the joint portion detecting sensor 132 detects a joint portion at step S2. Specifically, when a detected signal is not input to the central processing unit 200A of the control computer 200 from the joint portion detecting sensor 132, the determination is made that the joint portion detecting sensor 132 is not detecting a joint portion. When the detected signal is input, the determination is made that a joint portion is detected.

When the determination is made that a joint portion is not detected at step S2, the central processing unit 200A reads the width w1 and the thickness t1 of the support web W on the downstream side of the joint portion from the production control computer 300 at step S4.

Next the central processing unit 200A reads the temperature history data related with the thickness t1 from the storage device 200B at step S6.

A temperature history curve which is the closest to the predetermined temperature history is selected from the temperature history data, and the air flow rate V1 that corresponds to the selected temperature history curve is obtained at step S8. Since the air flow rate V1 is air flow rate per width of 1 m of the support web W, when the width of the support web W is w1, the air flow rate V1 is multiplied by w1 so that air flow rate which is necessary for giving the predetermined temperature history is obtained.

After the necessary air flow rate is obtained, the opening of the variable dampers 108A and 108B is controlled at step S10 so that the air flow rate of the heated air to be introduced from the supply flow channel 110 into the heating zone 106 becomes the above air flow rate. A determination is made at step S12 whether the actual air flow rate of the heated air stream matches with the necessary air flow rate, based on the signal from the supply air flow rate sensor 132. When the actual air flow rate of the heated air stream does not match with the necessary air flow rate, step S10 is repeated.

When the determination is made that the joint portion is detected at step S2, the central processing unit 20A reads the width w2 and the thickness t2 of the support web W on the upstream side of the joint portion from the production control computer 300 at step S14.

The central processing unit 200A reads the temperature history data relating to the thickness t2 from the storage device 200B at step S16.

A temperature history curve which is the closest to the predetermined temperature history is selected from the temperature history data, and the air flow rate V1' related with the selected temperature history curve is obtained at step S18. Since the air flow rate V1' is the air flow rate per width of 1 m of the support web W, when the width of the support web W is w2, the air flow rate V1' is multiplied by w2 so that the air flow rate which is necessary for giving the predetermined temperature history is obtained.

After the necessary air flow rate is obtained, the opening of the variable dampers 108A and 108B is controlled at step S20 so that the air flow rate of the heated air stream to be introduced from the supply flow channel 6 into the heating zone 106 becomes the above air flow rate. A determination is made at step S22 whether the actual air flow rate of the heated air stream matches with the necessary air flow rate, based on the signal from the supply air flow sensor 60. When the actual air flow rate of the heated air stream does not match with the necessary air flow rate, step S20 is repeated.

In the drying line 1016, an air stream flows on the downstream side of the second auxiliary blower 122 through the return flow channel 114 which return air stream comprises: a bypass air stream, which is the heated air stream bypassed through the bypass flow channel 116; and a portion of the discharged air stream discharged from the heating zone 106 which is returned to channel 14 (i.e., a return air stream).

A total of the air flow rate of the bypass air stream and the return air stream is equal to the air flow rate obtained by subtracting the air flow rate of the discharge air stream to be discharged out of the heating zone 106 from the air flow rate of the heated air stream generated by the heated air stream generating device 130. When the opening of the variable damper 118 is fixed to a constant value, the air flow rate of the discharge air stream to be discharged out of the heating zone 106 is constant. A fresh air stream is fed at a constant air flow rate from the blower 102.

Since, therefore, the air flow rate of the air stream passing through the heater 104 is constant, a heat load of the heater 104 is constant regardless of the air flow rate of the introduced air stream as the heated air stream to be introduced into the heating zone 106. Since, therefore, the temperature of the outlet of the heater 104 becomes stable, the quantity of heat to be fed to the support web w can be controlled accurately by increasing or decreasing the air flow rate of the introduced air stream to be introduced into the heating zone 106. This is clear form FIG. 18.

Figure 18:
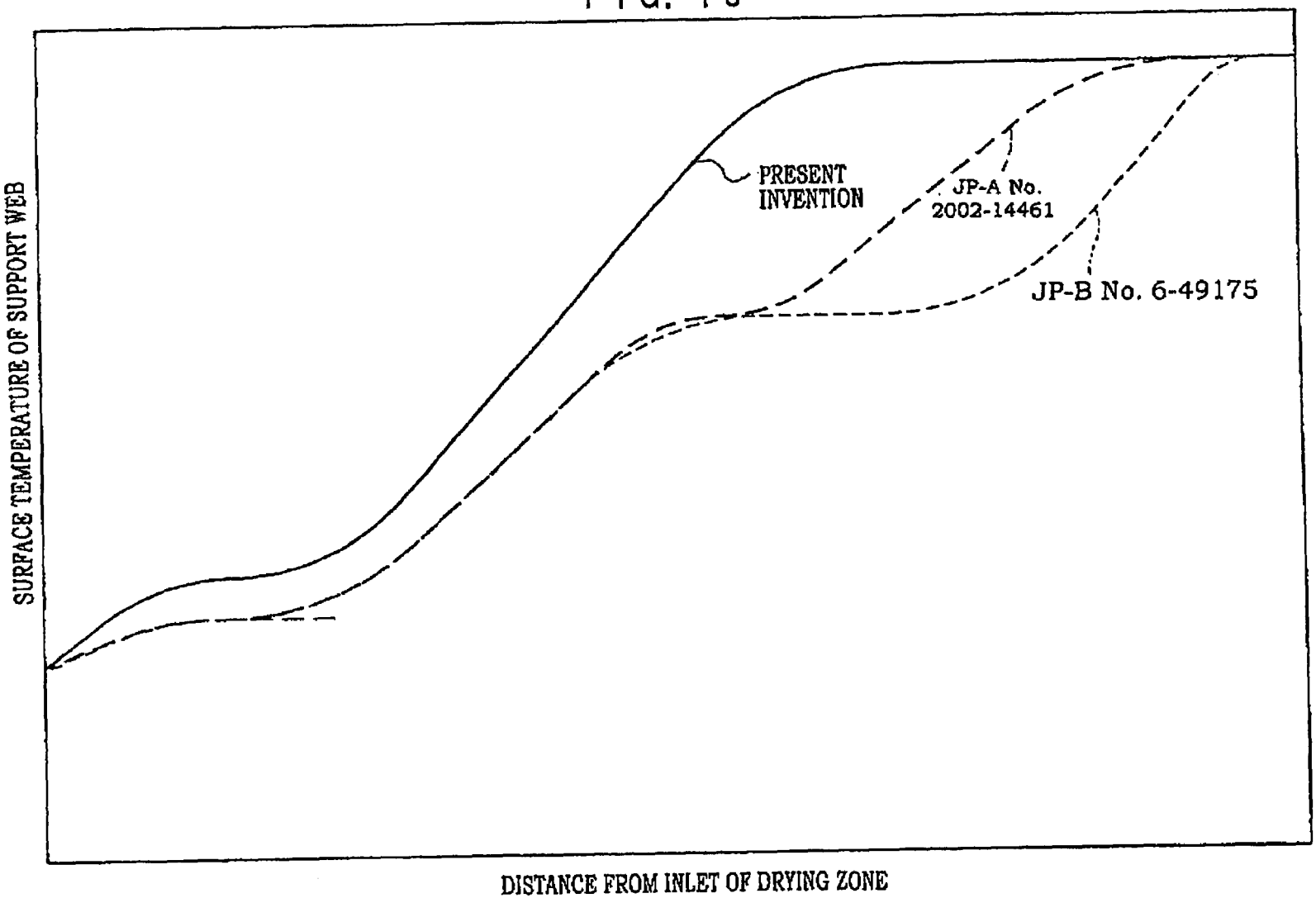
FIG. 18 is a graph illustrating a relationship between a distance from an inlet of a heating zone provided to the drying line shown in FIG. 14 and surface temperature of a support web in methods of the invention (ninth embodiment), JP-B No. 6-49175 and JP-A No. 2002-14461.

FIG. 18 is a graph illustrating a relationship between the distance from the inlet of the heating zone 106 and the surface temperature of the support web W according to the methods in the present invention (ninth embodiment), JP-B No. 6-49175, and JP-A No. 2002-14461.

The method in JP-B No. 6-49175 is a method for first drying a coating liquid such as a plate-making layer forming liquid applied to a roughened surface of a continuously running support web to touch dry in a heating zone, and then evaporating residual solvent in a coating film using a heating roller. The method in JP-A No. 2002-14461 is for drying a photosensitive coating layer using a first heating unit to the state of touch dry, and then accelerating hardening of the photosensitive coating layer using a second heating unit provided to the downstream side of the first heating unit.

As shown in FIG. 18, the surface temperature of the support web reaches the predetermined temperature at approximately the central portion of the heating zone 106, and is in a steady state thereafter in the ninth embodiment. In the methods in JP-B No. 6-49175 and JP-A No. 2002-14461, however, the surface temperature of the support web reaches the predetermined temperature only when it finally approaches the outlet of the heating zone 106.

The control computer 200 controls the flow rate of air introduced into the heating zone 106 so that the support web W is heated with the same constant temperature history regardless of the width w and the thickness t of the support web W. For this reason, even when, for example, the support web W has a joint portion and width W and thickness t changed either side of a joint portion, the temperature history does not differ either. (upstream and downstream) side of the joint portion.

When a plate-making layer forming liquid or a protective layer forming liquid was dried by using the drying line 1016, even planographic printing plates whose quality is greatly influenced by heating history, such as thermal CTP, can be manufactured with stable quality.

Further, with drying with heated air in the heating zone 106, the plate-making layer forming liquid or the like applied to the support web W can be dried in a non-contact manner. In the heating zone 106, therefore, differently from a case using a heating roller, there is no possibility that the back surface of the support web W is rubbed by the heating roller and thus is damaged, which rubbing is caused by a difference between the conveying speed of the support web W and a peripheral speed of the heating roller and/or temperature differences between the support web W and the surface of the heating roller and the like. The ninth embodiment is preferable from this viewpoint.

The case of one example of a heating zone 106 is explained. The drying line 1016, however, may have plural blocks that are joined in a serial fashion. An air stream supply flow channel and a return flow channel can be provided to the blocks, so that the air flow rates of the heated-air streams can be controlled independently.

The support web which can be processed in the drying line 1016 and the coating liquid which can be applied to the support web are explained in detail below.

An example of the support web is a support web which is obtained by carrying out: a mechanical surface roughening process, such as a brush grain process or a roller polishing process using a polishing roller, to at least one surface of an aluminum web as a band-shaped aluminum thin plate; an alkali etching process on the aluminum web thus treated, using an alkaline solution such as caustic soda; and once or more than once an electrolysis surface roughening process so as to grain the aluminum web by applying an alternating electric current in an acidic electrolyte including dilute hydrochloric acid or dilute nitric acid.

When the aluminum web is subject to the alkali etching process, smut is deposited on the surface of the aluminum web, and thus it is preferable that the deposited smut is removed by executing a desmutting process between the alkali etching process and the electrolysis surface roughening process.

After the aluminum web is grained and it is subject to an anodizing process so that an anodized layer is formed, a hydrophilic process using a high-temperature water vapor and a water glass solution is executed thereon. As a result, an abrasion resistant layer can be formed on the surface together with a hydrophilic layer.

An undercoat (primer) layer can be provided onto the grained surface of the support web manufactured in such a manner, so that the adhesive properties between the support web and the plate-making layer may be reinforced. Examples of components of the undercoat layer compound which can be given are:

Polysaccharides and derivatives thereof such as carboxymethyl cellulose, dextrin, or gum arabic;

organic phosphonic acids such as 2-aminoethyl phosphonic acid, phenyl phosphonic acid, naphthyl phosphonic acid, alkyl phosphonic acid, glycero phosphonic acid, methylene diphosphonic acid, and ethylene diphosphonic acid;

organic phosphoric acid such as phenyl phosphoric acid, naphythyl phosphoric acid, alkyl phosphoric acid, and glycero phosphoric acid;

organic phosphinic acid such as phenyl phosphinic acid, naphthyl phosphinic acid, alkyl phosphinic acid, and glycero phosphinic acid;

amino acid such as glycin and beta-alanine; and hydrochloride of amine containing hydroxyl group such as triethanoleamine.

The primer layer can be formed by, for example, a solution obtained by dissolving the above compounds in a suitable solvent such as water, methanol, ethanol, methyl ethyl ketone being applied to the grained surface of the support web and dried.

The forming amount of the primer layer is suitably 2 to 200 $mg/m^2$ and preferably 5 to 100 $mg/m^2$.

The anodizing process and the hydrophilic process are executed to the support web, the support web is optionally provided with a primer layer, various plate-making layer forming liquids are applied to the support web, and the liquids are dried so that a photosensitive or heat-sensitive plate-making layer is formed, thereby obtaining a planographic printing plate. A protective layer forming liquid can be further provided to the planographic printing plate by applying a protective layer forming liquid to the plate-making layer and drying the liquid.

Examples of planographic printing plates which can be manufactured by the drying line 1016 include a conventional type positive printing plate, a conventional type negative printing plate, a photopolymer type CTP plate, a thermal positive type CTP plate, and a thermal negative type CTP plate. The conventional type positive printing plate generally has a photosensitive plate-making layer mainly containing naphthoquinone diazide and phenyle resin. The conventional type negative printing plate generally has a photosensitive plate-making layer mainly containing diazonium salts, alkali soluble resin and binder resin. The photopolymer type CTP plate generally has a photopolymer photosensitive layer containing ethylene unsaturated compound, photopolymerization initiator and binder resin and an overcoat layer which protects the photopolymer photosensitive layer from oxygen. The thermal positive type CTP plate generally has a thermal plate-making layer mainly containing phenyl resin, acrylic resin and IR dye. The thermal negative type CTP plate generally has a thermal plate-making layer containing pyrolysis acid generator, thermal cross-linking agent, reactive polymer and IR dye. An abrasion resistant topcoat layer mainly containing phenyl resin may be formed on the surface of the thermal positive type CTP printing plate.

Another examples of planographic printing plates which can be manufactured by the dying line 1016 includes a thermal abrasion type non-treatment printing plate, an optical function-conversion type non-treatment printing plate, a thermal fusion non-treatment printing plate, a silver salt diffusion transfer type printing plate using a silver salt diffusion type transfer method.

For the support of the planographic printing plate, the support web, paper, laminated papers, synthetic resin films, semi-synthetic resin films, and the like can be used. The laminated paper is constituted so that paper is laminated to polyethylene, polypropylene, polystyrene, and/or the like. The synthetic and semi-synthetic resin films include cellulose diacetate resin, cellulose triacetate resin, polyethylene terephthalate resin, polyethylene resin, polypropylene resin, ethylene-propylene copolymer, polycarbonate resin, and polyvinyl acetal resin. Metals such as aluminum may be deposited or laminated onto the paper, the laminated paper, the synthetic resin film, and the semi-synthetic resin film.

The heating method for a band-shaped body and the heating apparatus for a band-shaped body of the invention are used as appropriate for cases where the plate-making layer forming liquid or the protective layer forming liquid is dried so as to form the plate-making layer or the protective layer, or in cases where the formed plate-making layer is subject to a curing process in the manufacturing of the CTP printing plates.

Particularly in the manufacturing of the thermal-type CTP printing plate, the heating method and apparatus for a band-shaped body are preferably used for the forming of the plate-making layer and/or the protective layer and the curing of the plate-making layer.

The heating method for a band-shaped body and the heating apparatus for a band-shaped body of the invention can be used appropriately not only for manufacturing the CTP plates but also for manufacturing conventional printing plates.

The heating method for a band-shaped body and the heating apparatus for a band-shaped body of the invention can be used for cases where a magnetic recording layer forming liquid is applied to a band-shaped base material and dried so that a magnetic layer is formed, or the cases where a protective layer is formed on the surface of the magnetic layer in manufacturing lines for magnetic recording media such as audio tapes, video tapes and floppy discs.

The heating method for a band-shaped body and the heating apparatus for a band-shaped body of the invention can be used in cases where an emulsion, an antihalation layer forming liquid or a gelatin solution is applied to a film base or baryta paper so that a photosensitive layer, an antihalation layer, or a gelatin layer is formed in the manufacturing lines of photographic films and cinefilms, or in the manufacturing lines of photographic papers.

What is claimed is:

1. A heating method for a band-shaped body transported in a constant conveying direction in a heating zone so as to heat it, comprising:

detecting whether or not a joint portion of the band-shaped body is passing through the heating zone, at which joint portion a first band-shaped body is joined to a second band-shaped body with at least one of different width or different thickness;

before detecting the joint portion pass into the heating zone, setting a first supplied heat quantity based on dimensions of the first band-shaped body on a downstream side of the joint portion in the conveying direction, and supplying heat with the first supplied quantity to the band-shaped body in the heating zone; and after detecting that the joint portion has passed into the heating zone, setting a second supplied heat quantity based on dimensions of the second band-shaped body on an upstream side of the joint portion relative to the conveying direction, and supplying heat with the second supplied quantity to the band-shaped body in the heating zone, so as to adjust a temperature history of the band-shaped body so that the temperature history is approximately uniform on both upstream and downstream sides of the joint portion.

2. The heating method for a band-shaped body of claim 1, further comprising:

dividing the heating zone into two or more blocks in the conveying direction of the band-shape body; and when the joint portion of the band-shaped body passes through the heating zone, changing the supplied heat quantity of the blocks successively starting from the block on the upstream side relative to the conveying direction of the band-shaped body.

3. The heating method for a band-shaped body of claim 1, further comprising:

applying a heated air stream to a path of the passing band-shaped body so as to heat a coating liquid in the heating zone; and increasing or decreasing at least one of air flow rate or temperature of the heated air stream so as to change the quantity of heat fed to the band-shaped body.

4. The heating method for a band-shaped body of claim 1, wherein the passing of the joint portion of the band-shaped body is detected on the upstream side of the heating zone relative to the conveying direction, and the supplied heat quantity in the heating zone is changed based on the detected result.

5. The heating method for a band-shaped body of claim 1, further including:

in the heating zone, conveying in a constant direction the band-shaped body having a coating liquid provided to at least one surface thereof; and simultaneously heating the band-shaped body so that the coating liquid is dried.

6. The heating method for a band-shaped body of claim 5, wherein the band-shaped body is a planographic printing plate.

7. A heating apparatus for a band-shaped body, comprising:

a heating zone, where a heated air stream is applied to at least one surface of a band-shaped body being conveyed in a constant direction so as to heat the band-shaped body;

a heated air stream generating unit, that generates a heated air stream; and a heated air stream supply flow channel for introducing the heated air stream generated by the heated air stream generating unit into the heating zone, wherein: the heated air stream generating unit has: an air stream generating unit that generates an air stream; and a heating unit that heats the air stream generated by the air stream generating unit;

in the heated air stream generating unit, the air stream generating unit generates air stream with a constant air flow rate and the air stream thus generated is made to pass through the heating unit, so as to generate the heated air stream with a constant air flow rate and constant temperature; and the heated air stream supply flow channel has a heated air flow rate adjusting unit that adjusts, when introducing the heated air stream generated by the heated air stream generating unit into the heating zone, the air flow rate of the air stream to be introduced.

8. The heating apparatus for a band-shaped body of claim 7, capable of:

detecting a joint portion pass through the heating zone, at which joint portion a first band-shaped body is joined to a second band-shaped body with at least one of different width or different thickness;

before detecting the joint portion pass into the heating zone, setting a first supplied heat quantity based on dimensions of the first band-shaped body on a downstream side of the joint portion relative to the conveying direction, and adjusting an air flow rate of the heated air stream to be fed into the heating zone by using a heated air stream air flow rate adjusting unit so that heat with the first supplied quantity is fed to the band-shaped body in the heating zone; and after detecting that the joint portion has passed into the heating zone, setting a second supplied heat quantity based on dimensions of the second band-shaped body on an upstream side of the joint portion relative to the conveying direction, and adjusting the air flow rate of the heated air stream to be supplied into the heating zone by the heated air flow rate adjusting unit so that heat with the second supplied quantity is fed to the band-shaped body in the heating zone, and thus a temperature history of the band-shaped body is capable of being adjusted so as to be approximately uniform on both upstream and downstream sides of the joint portion.

9. The heating apparatus for a band-shaped body of claim 7, further comprising:

a bypass flow channel that is branched from the heated air stream supply flow channel, and is used for bypassing at least part of the heated air stream generated by the heated air stream generating unit away from the heating zone; and an air flow ratio changing unit, while the air flow ratio changing unit maintains a constant sum of introduced air stream flow rate and bypass air stream flow rate, the introduced air stream flow rate being the flow rate of the heated air stream supplied to the heating zone through the heated air stream supply flow channel, and the bypass air stream flow rate being the air flow rate of the heated air stream bypassed in the bypass flow channel, the air flow ratio changing unit changes the ratio of the introduced air stream flow rate to the bypass air stream flow rate.

10. The heating apparatus for a band-shaped body of claim 9, further comprising a return flow channel for: combining, on downstream of the heating zone, the heated air stream which was introduced into the heating zone and the heated air stream which was introduced into the bypass flow channel; and returning at least part of the combined air stream to the heating unit.

11. The heating apparatus for a band-shaped body of claim 7, further comprising:

a joint portion detecting unit provided on an upstream side of the heating zone, which unit can detect the passing of a joint portion of the band-shaped body through the heating zone, at which joint portion a first band-shaped body is joined to a second band-shaped body with at least one of different width or different thickness;

a production management information storage unit that stores production management information relating to the width and thickness of the band-shaped body passing through the heating zone; and a control unit that, when the joint portion detecting unit detects the joint portion, reads the width and the thickness of the portion of the band-shaped body on the upstream side of the joint portion from the production management information storage unit, controls the heated air flow rate adjusting unit or the heated air stream introduction ratio adjusting unit and sets an introduced air flow rate or an introduction ratio of the heated air streams based on the read width and thickness, so that a temperature history of the band-shaped body becomes substantially uniform on both upstream and downstream sides of the joint portion.

12. The heating apparatus for a band-shaped body of claim 11, wherein the heating zone is divided into two or more blocks in the conveying direction of the band-shaped body, and when the joint portion detecting unit detects the joint portion, the supplied heat quantity is changed successively starting from the block on the upstream side of the heating zone.

13. The heating apparatus for a band-shaped body of claim 7, wherein the band-shaped body is a support web comprising a base material of a planographic printing plate, and the heating apparatus for a band-shaped body heats and dries a coating liquid applied to at least one surface of the support web.

14. The heating apparatus for a band-shaped body of claim 7, wherein detection can be made whether or not a portion of the band-shaped body is passing through the heating zone, at which portion at least one of width and thickness of the band-shaped body changes;

before detection of the portion passing into the heating zone, a first supplied heat quantity is set based on dimensions of the band-shaped body on a downstream side of the portion relative to the conveying direction, and the flow rate of the heated air stream supplied to the heating zone is adjusted by the heated air flow rate adjusting unit such that heat with the first supplied quantity is supplied to the band-shaped body; and after passing of the portion into the heating zone is detected, a second supplied heat quantity is set based on dimensions of the band-shaped body on an upstream side of the portion relative to the conveying direction, and the flow rate of the heated air stream supplied to the heating zone is adjusted by the heated air flow rate adjusting unit such that heat with the second supplied quantity is supplied to the band-shaped body, so as to adjust a temperature history of the band-shaped body so that it becomes approximately uniform on both upstream and downstream sides of the portion in the conveying direction.

15. A heating apparatus for a band-shaped body, comprising:

a heating zone, where a heated air stream is applied to at least one surface of a band-shaped body being conveyed in a constant direction so as to heat the band-shaped body;

a plurality of heated air stream generating units that generate heated air streams with different temperatures;

a heated air stream supply flow channel for introducing the heated air stream generated by the heated air stream generating units into the heating zone; and a heated air stream introduction ratio adjusting unit provided on the heated air stream supply flow channel that adjusts a ratio of the heated air streams to be introduced into the heating zone from the heated air stream generating units, wherein, in the heated air stream generating units, air streams with constant air flow rates is made to pass through heating units so as to generate the heated air streams.

16. The heating apparatus for a band-shaped body of claim 15, further comprising:

a joint portion detecting unit provided on an upstream side of the heating zone, which unit can detect the passing of a joint portion of the band-shaped body through the heating zone, at which joint portion a first band-shaped body is joined to a second band-shaped body with at least one of different width or different thickness;

a production management information storage unit that stores production management information relating to the width and thickness of the band-shaped body passing through the heating zone; and a control unit that, when the joint portion detecting unit detects the joint portion, reads the width and the thickness of the portion of the band-shaped body on the upstream side of the joint portion from the production management information storage unit, controls the heated air flow rate adjusting unit or the heated air stream introduction ratio adjusting unit and sets an introduced air flow rate or an introduction ratio of the heated air streams based on the read width and thickness, so that a temperature history of the band-shaped body becomes substantially uniform on both upstream and downstream sides of the joint portion.

17. A heating apparatus for a band-shaped body, comprising:

a heating zone, where a heated air stream is applied to at least one surface of a band-shaped body being conveyed in a constant direction so as to heat the band-shaped body;

a plurality of heated air stream generating units that generate heated air streams with different temperatures;

a heated air stream supply flow channel for introducing the heated air streams generated by the heated air stream generating units into the heating zone; and a heated air stream supply flow channel switching unit provided on the heated air stream supply flow channel, for switching the heated air stream supply flow channel so that a heated air stream is introduced from at least one of the heated air stream generating units into the heating zone, wherein, in the heated air stream generating units, air streams with constant air flow rates is made to pass through heating units so as to generate the heated air streams.

18. The heating apparatus for a band-shaped body of claim 17, further comprising:

a joint portion detecting unit provided on an upstream side of the heating zone, which unit can detect the passing of a joint portion of the band-shaped body through the heating zone, at which joint portion a first band-shaped body is joined to a second band-shaped body with at least one of different width or different thickness;

a production management information storage unit that stores production management information relating to the width and thickness of the band-shaped body passing through the heating zone; and a control unit that, when the joint portion detecting unit detects the joint portion, reads the width and the thickness of the portion of the band-shaped body on an upstream side of the joint portion from the production management information storage unit, controls one of a heated air flow rate adjusting unit and a heated air stream introduction ratio adjusting unit and sets one of an introduced air flow rate and an introduction ratio of the heated air streams based on the read width and thickness, so that a temperature history of the band-shaped body becomes substantially uniform on both upstream and downstream sides of the joint portion.

19. A heating method for a band-shaped body transported in a constant conveying direction in a heating zone so as to heat it, comprising:

detecting whether or not a portion of the band-shaped body is passing through the heating zone, at which portion at least one of width and thickness of the band-shaped body changes;

before detecting the portion pass into the heating zone, setting a first supplied heat quantity based on dimensions of the first band-shaped body on a downstream side of the portion in the conveying direction, and supplying heat with the first supplied quantity to the band-shaped body in the heating zone; and after detecting that the portion has passed into the heating zone, setting a second supplied heat quantity based on dimensions of the second band-shaped body on an upstream side of the portion relative to the conveying direction, and supplying heat with the second supplied quantity to the band-shaped body in the heating zone, so as to adjust a temperature history of the band-shaped body so that the temperature history is approximately uniform on both upstream and downstream sides of the portion.

20. The heating method for a band-shaped body of claim 19, further comprising:

applying a heated air stream to a path of the passing band-shaped body so as to heat a coating liquid in the heating zone; and increasing or decreasing at least one of air flow rate or temperature of the heated air stream so as to change the quantity of heat fed to the band-shaped body.

* * * * *